US007028476B2

(12) United States Patent
Proeschel

(10) Patent No.: US 7,028,476 B2
(45) Date of Patent: Apr. 18, 2006

(54) AFTERBURNING, RECUPERATED, POSITIVE DISPLACEMENT ENGINE

(75) Inventor: Richard Alan Proeschel, Thousand Oaks, CA (US)

(73) Assignee: Proe Power Systems, LLC, Medina, OH (US)

( * ) Notice: Subject to any disclaimer, the term of this patent is extended or adjusted under 35 U.S.C. 154(b) by 0 days.

(21) Appl. No.: 11/131,968

(22) Filed: May 18, 2005

(65) Prior Publication Data

US 2005/0257523 A1 Nov. 24, 2005

Related U.S. Application Data

(60) Provisional application No. 60/573,575, filed on May 22, 2004.

(51) Int. Cl.
*F02G 3/00* (2006.01)

(52) U.S. Cl. ..... 60/616; 60/646; 60/660

(58) Field of Classification Search ..... 60/616, 60/618, 508, 646, 660
See application file for complete search history.

(56) References Cited

U.S. PATENT DOCUMENTS

| | | | | |
|---|---|---|---|---|
| 1,813,543 | A | 7/1931 | Pescara | |
| 2,067,453 | A | 1/1937 | Lee | |
| 2,438,635 | A | 3/1948 | Haverstick | |
| 3,237,847 | A | 3/1966 | Wilson | |
| 3,621,654 | A | 11/1971 | Hull | |
| 3,708,979 | A * | 1/1973 | Bush et al. | 60/522 |
| 3,756,022 | A | 9/1973 | Pronovost et al. | |
| 3,893,300 | A | 7/1975 | Connell | |
| 4,224,798 | A | 9/1980 | Brinkerhoff | |
| 4,333,424 | A * | 6/1982 | McFee | 123/39 |
| 4,553,285 | A | 11/1985 | Sachs et al. | |
| 4,632,042 | A | 12/1986 | Chang | |
| 4,663,939 | A | 5/1987 | Cosby | |
| 4,751,814 | A * | 6/1988 | Farrell | 60/39.183 |
| 4,791,787 | A * | 12/1988 | Paul et al. | 60/605.1 |
| 4,864,814 | A | 9/1989 | Albert | |
| 4,936,262 | A * | 6/1990 | Paul et al. | 123/25 C |
| 5,894,729 | A | 4/1999 | Proeschel | |
| 6,012,280 | A | 1/2000 | Hufton | |
| 6,349,658 | B1 | 2/2002 | Tyer | |
| 6,390,185 | B1 | 5/2002 | Proeschel | |
| 6,606,860 | B1 | 8/2003 | McFarland | |
| 6,672,063 | B1 | 1/2004 | Proeschel | |
| 6,718,751 | B1 | 4/2004 | Mehail | |

OTHER PUBLICATIONS

Elmegaard et al; "Thermodynamic Analysis of Supplementary-Fired Gas Turbine Cycles"; ECOS 2002, Berlin 2002; Denmark.

Leidel, "An Optimized Low Heat Rejection Engine for Automotive Use—An Inceptive Study", SAE Paper 970068, 1997, USA.

* cited by examiner

*Primary Examiner*—Hoang Nguyen

(57) ABSTRACT

The invention is a positive displacement heat engine; where the engine cycle comprises the steps of Ericsson (isothermal) compression, recuperative heat addition, Brayton (adiabatic) expansion, and recuperative heat removal; whose principle is heat addition to the cycle by an afterburner in which fuel is burned with the low pressure air working fluid exhausted by the expander. The resulting combustion gases are used in a counterflow heat exchange recuperator to continually heat the high pressure air compressed by the compressor. All moving parts are only exposed to clean air, and the expander valves can be operated at temperatures comparable to current internal combustion engines. Liquid, solid or gaseous fuels can be used and control of speed and power is simple, based on keeping engine temperatures constant. The low-pressure continuous combustion avoids fuel pressurization problems and allows high efficiency, low emission combustion processes.

19 Claims, 20 Drawing Sheets

-Prior Art -

-Prior Art -

-Prior Art -

-Prior Art -

AFTERBURNING, RECUPERATED, POSITIVE DISPLACEMENT ENGINE

RELATED APPLICATION

This application claims the benefit of provisional patent application Ser. No. 60/573,575 filed 2004 May 22 by the present inventor.

BACKGROUND OF THE INVENTION

1. Field of the Invention

This invention relates to Brayton and Ericsson open cycle heat engines where the engine cycle comprises the steps of Ericsson (isothermal) compression, recuperative heat addition, Brayton (adiabatic) expansion, and recuperative heat removal. More particularly, it relates to a commercially viable, open cycle, positive displacement engine where heat addition to the cycle is effected solely through a recuperator by burning fuel in the expanded, low pressure, exhaust stream.

2. Description of Prior Art

The increasing world-wide demand for electrical and mechanical power production, combined with concern for the environment, has led to the need for new, practical, engines that can cleanly and efficiently produce that power from combustion of a wide variety of fuels.

Internal combustion engines are well developed but require highly refined liquid or gaseous fuels—fuels that are generally limited in supply and that have their primary sources in politically unstable regions. Furthermore, the combustion process in internal combustion engines, from ignition to extinction, must take place in hundredths of a second. Additional constraints to clean and efficient internal combustion result from the relatively fixed geometry of the combustion chamber and the need to provide smooth, detonation free, flame propagation. These constraints severely compromise the combustion process and lead to incomplete combustion that generates undesirable exhaust emissions.

External combustion engines offer impressive advantages over internal combustion engines. External combustion engines can accommodate a wide variety of fuels, in any phase, and without regard for detonation (knock) characteristics. They can use low pressure, continuous, combustion processes that allow long combustion times for maximum efficiency and minimum exhaust emissions. In turn, low pressure combustion easily incorporates catalytic burners, re-circulating bluff body flame holders, rich/lean staged combustion burners, and related leading edge technologies that are now being developed to provide nearly complete combustion with minimal harmful exhaust pollutants.

Finally, and importantly, low pressure external combustion uniquely lends itself to recovery of otherwise wasted exhaust heat for significant efficiency improvement through use of a counterflow heat exchanger to preheat the combustor air supply with the hot exhaust gas.

Just as engines can be defined as being internal combustion or external combustion, they can also be classed as closed cycle engines and open cycle engines. Closed cycle engines, such as steam engines and Stirling engines, use the same working fluid over and over to generate power by adding and removing heat through heat exchangers. Open cycle engines simply use air as the working fluid. The engine takes air in and exhausts air out as part of the power generation process. Open cycle engines have advantages over closed cycle engines in simplicity, cost, and efficiency because the air used in the power cycle can also be used in the combustion process to yield an integrated engine/combustion process that is both simple and efficient. The advantages of open cycle engines over closed cycle engines have caused steam engines to become increasingly obsolete and have prevented Stirling engines from becoming commercially viable.

From the previous paragraphs it would seem that an external low-pressure combustion, open cycle engine (ELPC/OC engine) would combine the best features to produce an optimal engine. However, at this time, there are no commercially successful ELPC/OC engines on the market. The reason is, although such an engine seems straightforward, the prior art has all encountered practical limitations.

The most promising prior art ELPC/OC engine is described in U.S. Pat No. 5,894,729 ("Afterburning Ericsson Cycle Engine", Proeschel, 1997). The Afterburning Ericsson Cycle (AEC) engine has all the ELPC/OC advantages of: being able to utilize a wide variety of fuels; having continuous, low pressure, combustion; and integrating the engine and combustor so that the combustion air is preheated by the exhaust. In addition, being based on the Ericsson cycle, the AEC has the potential for very high thermodynamic efficiency.

The AEC engine comprises a compressor having cooling provisions to allow it to approximate isothermal compression, a counterflow heat exchanger (recuperator) for heating the compressed air with heat recovered from the engine exhaust, an expander with heating passages to approximate isothermal expansion, and one or more afterburners in the expander exhaust that provide heat to the expander heating passages and to the recuperator.

The temperature entropy diagram of FIG. 1 shows the ideal AEC engine cycle. The cycle consists of:

- Point 1 to Point 2: Isothermal compression at ambient air temperature, Tc, from low pressure Po to high pressure P1.
- Point 2 to Point 3: Constant pressure recuperated heating from Tc to Th.
- Point 3 to Point 4: Isothermal expansion, at Th,
- Point 4 to 5 and Point 4*a* to 5*a:* Constant pressure combustion heating.
- Point 5 to 4*a* and Point 5*a* to 4*b:* Constant pressure cooling in heat transfer passages to provide the heat needed for Point 3 to Point 4.
- Point 4*b* to Point 1: Constant pressure recuperated cooling from Th to Tc.

The cycle of FIG. 1 has the efficiency of a Carnot cycle operating between Tc and Th. Since the Carnot cycle defines the maximum possible thermodynamic efficiency, the AEC is a very promising cycle.

At first it would seem that making a practical AEC engine would depend on a high level of success in achieving nearly isothermal expansion from Point 3 to Point 4. Surprisingly, in developing the AEC engine, it was found that, particularly at pressure ratios (P1/Po) less than about 6, the cycle efficiency was almost independent of the effectiveness in approaching ideal isothermal expansion.

FIG. 2 shows the predicted brake shaft efficiency of a typical prototype AEC design as a function of pressure ratio and expander heating effectiveness. (Expander heating effectiveness is the ratio of the actual heat transfer rate to the rate required for isothermal expansion.) The FIG. 2 results are for a constant recuperator inlet temperature (Point 4*b* in FIG. 1) of 816° C. (1500° F.) and include the effects of heat losses, pressure losses (particularly in the expander heat transfer passages), and mechanical losses.

The AEC engine efficiency is not strongly affected by expander heating effectiveness for two reasons. First, obtaining high expander heating effectiveness requires long and highly finned expander heating passages. The fins cause flow restriction and a high backpressure. Overcoming the high backpressure costs much of what is gained by heating the expander. Second, the heat that cannot be transferred to the expansion process is still available to the cycle through the recuperator process (Point 4*b* to Point 1). With a high recuperator effectiveness (93% in this case) high engine cycle efficiency is still obtainable.

FIG. 3 shows the required peak combustion temperatures corresponding to the same conditions as FIG. 2. Higher combustion temperatures are needed to provide the higher heat transfer rates for higher values of expander heating effectiveness. However, the higher combustion temperatures are undesirable because they increase the amount of nitrogen oxides (NOx) produced from the combustion process and because they increase engine thermal stress.

The AEC development results of FIG. 2 and FIG. 3 show there is a strong case for simplifying the AEC engine by doing away with the expander heating passages (corresponding to the case of zero expander heating effectiveness). Construction is simplified, peak temperatures are reduced, and, with practical pressure ratios, the engine efficiency is essentially unchanged.

Eliminating the expansion heating from FIG. 2 results in the ideal cycle of FIG. 4. The expansion process, Point 3 to Point 4, is adiabatic or isentropic. A single heating process then heats the air to the recuperator inlet temperature, Th, at Point 5. The exhaust heat from Point 5 to Point 1 is transferred through the recuperator to provide the heat for Point 2 to Point 3.

U.S. Pat. No. 2,438,635 ("Turbine System Utilizing Hot Driving Gases", Haverstick, 1948) teaches a turbine system roughly operating according to FIG. 4. However, Haverstick's patent includes the additional and counterproductive complexity of splitting the exhaust flow in two and introducing the second half of the flow at an intermediate point in the recuperator.

U.S. Pat. No. 3,621,654 ("Regenerative Gas Turbine Power Plant", Hull, 1971) covers almost all possible combinations of recuperated Brayton cycle engines, including engines operating on the cycle of FIG. 4. However, Hull teaches turbine machines for the compression and expansion processes. Turbine engines are viable for large powerplants but do not work well for smaller powerplants. Blade edge losses are difficult to control with smaller size turbines and the high turbine speed makes integration with electrical generators difficult. Also turbine engines cannot be built or maintained in small local machine shops whereas positive displacement engines, particularly in micro-generation sizes, can easily be built and maintained in automotive machine shops.

U.S. Pat. No. 3,893,300 ("External Combustion Engine and Engine Cycle", Connell, 1975) teaches an engine operating on the FIG. 4 cycle with a positive displacement compressor and a turbine expander. Connell recognizes the limitations of small turbines for the compression process but still teaches a turbine for the expansion process. Furthermore, Connell teaches the need for heat storage means to facilitate rapid response to load changes. He failed to appreciate that an actual recuperator capable of achieving the high heat transfer effectiveness needed to achieve high engine efficiency will inherently have substantial thermal storage capability. Connell's heat storage means is therefore unnecessary and can be omitted without loss of capability.

U.S. Pat. No. 3,756,022 ("External Combustion Engine", Pronovost et. al., 1973) teaches an engine operating roughly according to FIG. 4 having a positive displacement, reciprocating, expander. However, Pronovost's invention is inoperative because he failed to appreciate the key needs for cooling the compressor, insulating the exparider, and protecting the reciprocating expander seals and mechanisms from high temperature. He also teaches a combined combustor/recuperator or "heating chamber" which acts as a cross flow heat exchanger. Pronovost did not understand that a high effectiveness counterflow recuperator is another key requirement to make this type of engine a practical commercial success.

It is the primary aim of this invention to overcome the disadvantages of current ELPC/OC engines discussed above and to achieve a practical, commercially successful ELPC/OC engine having high efficiency, low emissions, ease of control, and economy of manufacture by implementing the several objects listed below.

OBJECTS OF THE INVENTION

It is an object of this invention to provide a practical, low cost, easily manufactured, external low-pressure combustion, open cycle (ELPC/OC) engine.

It is an essential object to provide an ELPC/OC engine that is possible to construct with essentially the same methods, materials, and tools used to build conventional internal combustion engines.

It is an additional object to provide an ELPC/OC engine that can obtain a high thermodynamic efficiency.

It is another object to provide an ELPC/OC engine in which the combustion process is totally continuous, takes place at low pressure, and has very low exhaust emissions.

It is a still another object to provide an ELPC/OC engine in which all the moving parts are only exposed to clean air.

It is also an object to provide an ELPC/OC engine that can be fired by a wide variety of liquid, solid or gaseous fuels.

It is a further object that the ELPC/OC engine can be made using readily available internal combustion engine blocks for most of the expander mechanical parts.

It is another object that the ELPC/OC engine can be made using commercially available compressors by mechanically connecting the compressor to the expander drive shaft.

It is an additional object to provide an ELPC/OC engine in which power and speed are controlled instantly by a conventional throttle mechanism.

It is also an object to provide an ELPC/OC engine that operates at a low noise level.

SUMMARY OF THE INVENTION

An Afterburning, Recuperated, Positive Displacement Engine based on an Ericsson compressor and Brayton expander has been devised to implement the stated objects of the invention. The engine consists of a cooled compressor, a counterflow exhaust gas recuperator, an insulated expander, and an afterburning combustor.

The compressor uses conventional positive displacement air compressor technology to compress the incoming air working fluid in an approximation to isothermal compression. In its simplest form, a single stage air or water-cooled reciprocating compressor can be used. Alternatively, staged compressors with inter-cooling can provide an even closer approximation to isothermal compression, although with higher manufacturing cost. Another alternative is to use rotary, Roots-blower, compressors that are simpler but less efficient. In all cases, the mechanical power to drive the compressor is obtained by mechanical (belt, chain, shaft, gears etc.) connection to the expander.

The recuperator is a high temperature, high effectiveness, low pressure loss, counterflow heat exchanger that recovers the combustor exhaust heat to heat the compressed air before it enters the expander. The recuperator is derived from the recuperators used for recuperated gas turbine cycles. The preferred recuperator for this application is the recuperator of U.S. Pat. No. 6,390,185 ("Annular Flow Concentric Tube Recuperator", Proeschel, 2002).

Expanding the hot compressed air in the expander produces the gross mechanical work. The expander is a reciprocating device with valves to control the admission of hot compressed air and the exhaust of the cooler expanded air. A significant feature of the expander, for maximum efficiency and long engine life, are provisions for thermal isolation. Despite the extremely high temperature of the incoming compressed air working fluid, these provisions minimize the heat loss from the air to the surrounding environment and also permit the expander valve actuators, valve seals, and piston rings to operate at temperatures comparable to their conventional internal combustion engine counterparts.

The principal feature of the invention is heat addition to the cycle by an afterburner combustor assembly in which fuel is burned with the low pressure air that is exhausted from the expander. The expander exhaust air, even after adiabatic expansion, is still at an elevated temperature and so the expander exhaust provides preheated air for the afterburner combustion process. The preheated air greatly reduces the necessary combustion heating, conserving fuel and minimizing exhaust emissions. The hot products of combustion from the afterburning combustor assembly provide the heat to run the engine by being directed through the recuperator where those hot combustion products give up their heat to the incoming compressed air stream through counterflow heat exchange.

With a highly effective recuperator, the exhaust leaves the recuperator at a temperature near the compressor exit temperature. By providing effective compressor cooling, the compressor exit temperature can be made very low. Thus, the engine exhaust is at a relatively cool temperature and the energy lost in the exhaust is extremely low.

A number of distinct advantages of the Afterburning, Recuperated, Positive Displacement Engine can be listed:

1. At moderate pressure ratios (less than about 6) the cycle efficiency is competitive with an Afterburning Ericsson Cycle Engine. The high level of efficiency can be achieved with a much simpler expander and with lower combustion temperatures. The simpler expander reduces the cost to manufacture and enhances engine life. The lower combustion temperatures reduce both thermal stresses and nitrogen oxide exhaust emissions.
2. Long engine life is obtained by thermal control provisions that limit the temperatures of critical expander seals and mechanisms to the temperatures found in conventional internal combustion engines.
3. All moving parts are exposed only to clean air rather than combustion products that can limit life and performance from carbon buildup or chemical reactions.
4. With the low pressure continuous combustion process, no high-pressure fuel injector devices or high-pressure fuel seals are needed. This feature reduces initial cost, eliminates energy lost to compressing fuel, and improves fuel system safety.
5. The engine can be powered by a wide variety of liquid or gaseous fuels, including gasoline, diesel fuel, propane, bio-methane, natural gas and hydrogen.
6. The low pressure continuous combustion process facilitates the direct use of solid fuels to exploit renewable or bio-waste fuel sources without the need for a solid fuel gasifier.
7. Complete combustion and minimal air polluting emissions are facilitated by the low pressure continuous combustion.
8. The engine can be manufactured in conventional commercial machine shops.
9. The engine can be fabricated, to a large part, using commercially available internal combustion engine blocks and components for the expander bottom end, valves, and seals.
10. The engine can be fabricated using commercially available positive displacement compressors.
11. The Afterburning, Recuperated, Positive Displacement Engine can be controlled by conventional internal combustion engine throttle techniques. Speed and power are controlled by a butterfly valve on the compressor inlet coupled with variable fuel control. The aim is to maintain nearly constant engine temperatures while varying air and fuel flowrates. This produces rapid throttle response by avoiding thermal lags.
12. The engine has a low exhaust pressure that is conducive to quiet operation. Exhaust noise is further reduced by the muffling effect of the recuperator

BRIEF DESCRIPTION OF THE DRAWINGS

A better understanding of the invention may be gained by reference to the following Detailed Description in conjunction with the drawings provided in which:

FIG. 13 at zero and 360 degrees.

FIG. 14 at 45 degrees.

FIG. 15 at 90 degrees.

FIG. 16 at 135 degrees.

FIG. 17 at 180 degrees.

FIG. 18 at 225 degrees.

FIG. 19 at 270 degrees.

FIG. 20 at 315 degrees.

REFERENCE NUMBERS IN FIGS. 6, 7, 8, 9 and 10

| | |
|---|---|
| 1 | Compressor Assembly |
| 1A | Inlet Valve |
| 1B | Exhaust Valve |
| 1C | Piston |
| 1D | Connecting Rod |
| 1E | Cooling Fins |
| 1F | Water Jacket |
| 1G | Outlet Tube |
| 2 | Expander Assembly |
| 2A | Hot Cylinder Head |
| 2B | Cold Cylinder Head |
| 2C | Outlet Tube |
| 2D | Piston |
| 2E | Piston Insulating Extender |
| 2F | Piston Rings |
| 2G | Connecting Rod |
| 2H | Piston Ring Cooling Fins |
| 2I | Piston Ring Water Jacket |
| 2J | Insulation |
| 2K | Intake Valve |
| 2L | Exhaust Valve |
| 2M | Thermal Standoff |
| 2N | Cold Head Cooling Fins |
| 2O | Cold Head Water Jacket |
| 2P | Cams |
| 2Q | Valve Guide Thermal Standoff |
| 2R | Valve Guide |
| 2S | Valve Seal |
| 2T | Valve Guide Thermal Bridge |
| 2U | Valve Spring |
| 2V | Cylinder Insulating Extender |
| 3 | Recuperator |
| 3A | High Pressure Outlet |
| 3B | Exhaust Tube |
| 4 | Crank |

-continued

REFERENCE NUMBERS IN FIGS. 6, 7, 8, 9 and 10

| | |
|---|---|
| 5 | Air Filter |
| 6 | Throttle |
| 7 | Compressor Cooling Blower |
| 8 | Blower Drive Belt |
| 9 | Afterburner Assembly (Gas or Liquid Fuel) |
| 9A | Fuel Nozzle |
| 9B | Igniter |
| 10 | Afterburner Assembly (Solid Fuel) |
| 10A | Afterburner Furnace |
| 10B | Ash Pit |
| 10C | Hopper |
| 10D | Stoker |
| 11 | Start Blower |
| 11A | Start Blower Valve |

DETAILED DESCRIPTION OF THE PREFERRED EMBODIMENTS

Afterburning, Recuperated, Positive Displacement Engine Characteristics

Figure 1:
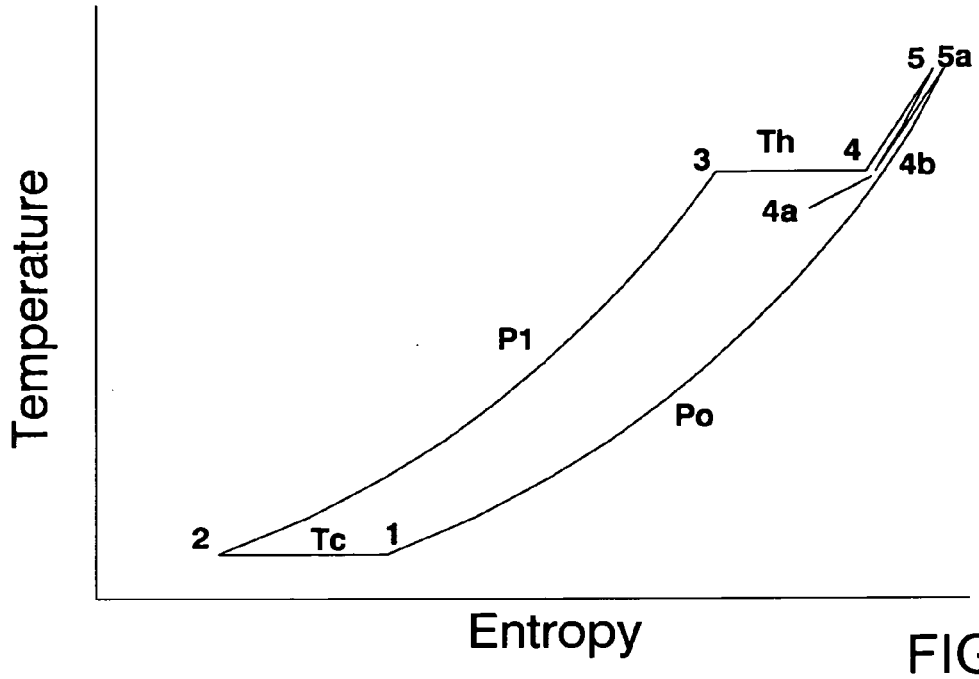
FIG. 1 is a temperature-entropy diagram of the ideal Afterburning Ericsson Cycle with two afterburners (described in the BACKGROUND OF THE INVENTION section).
Figure 2:
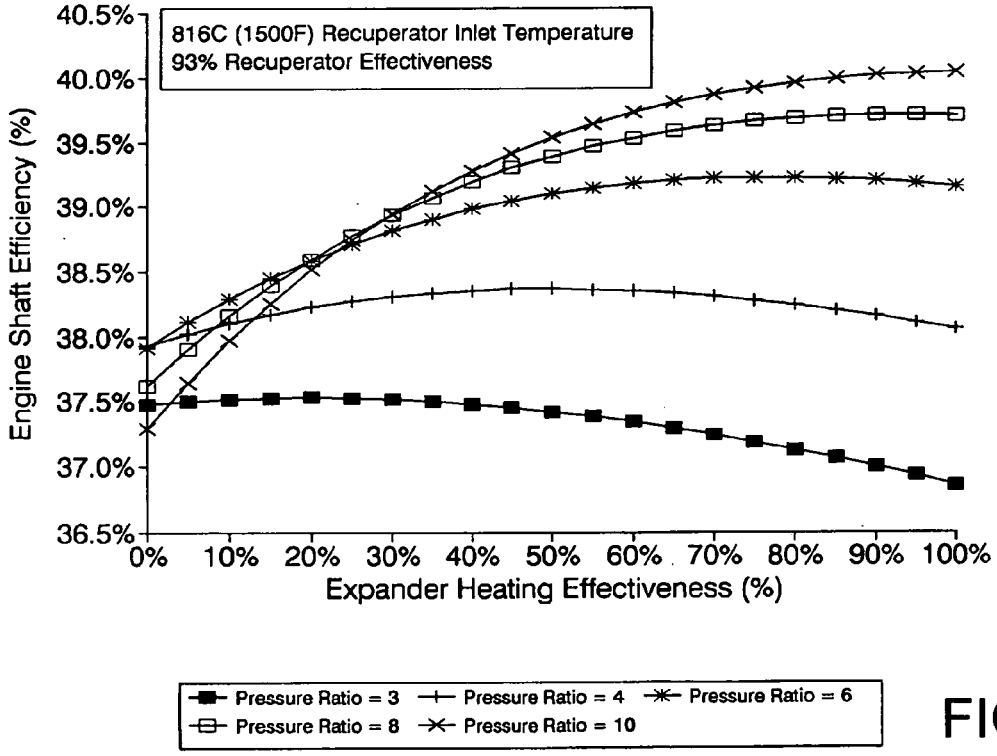
FIG. 2 is a graph of the predicted engine shaft efficiency of actual prototype Afterburning Ericsson Cycle engines as a function of pressure ratio and expander heating effectiveness (described in the BACKGROUND OF THE INVENTION section).
Figure 3:
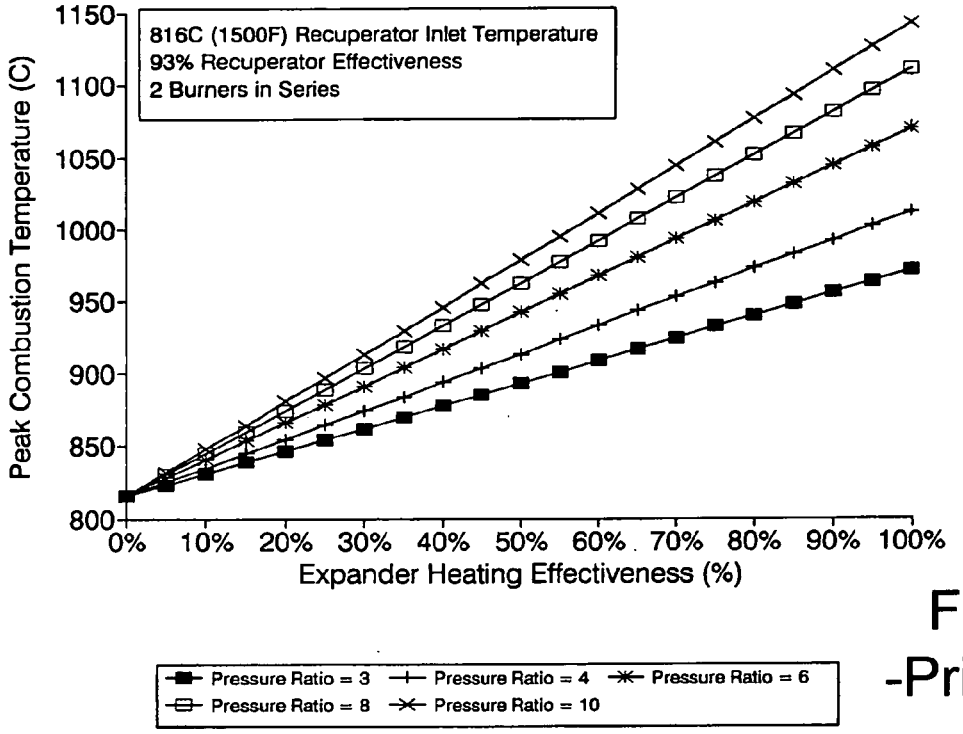
FIG. 3 is a graph of the predicted peak combustion temperature of actual prototype Afterburning Ericsson Cycle engines as a function of pressure ratio and expander heating effectiveness (described in the BACKGROUND OF THE INVENTION section).
Figure 4:
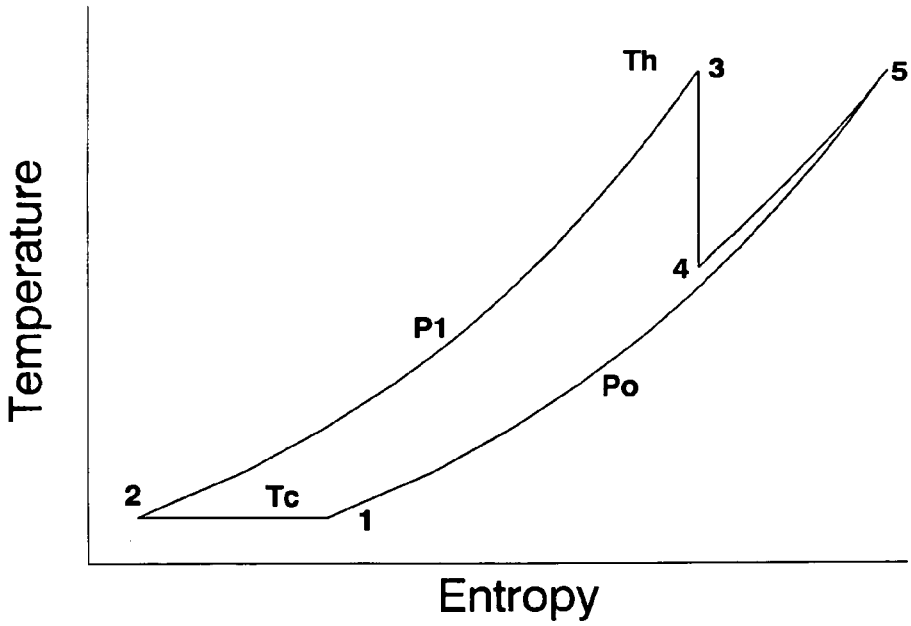
FIG. 4 is a temperature-entropy diagram of an ideal Afterburning, Recuperated, Open Cycle engine with an Ericsson (isothermal compressor) and Brayton (adiabatic) expander (described in the BACKGROUND OF THE INVENTION section).
Figure 5:
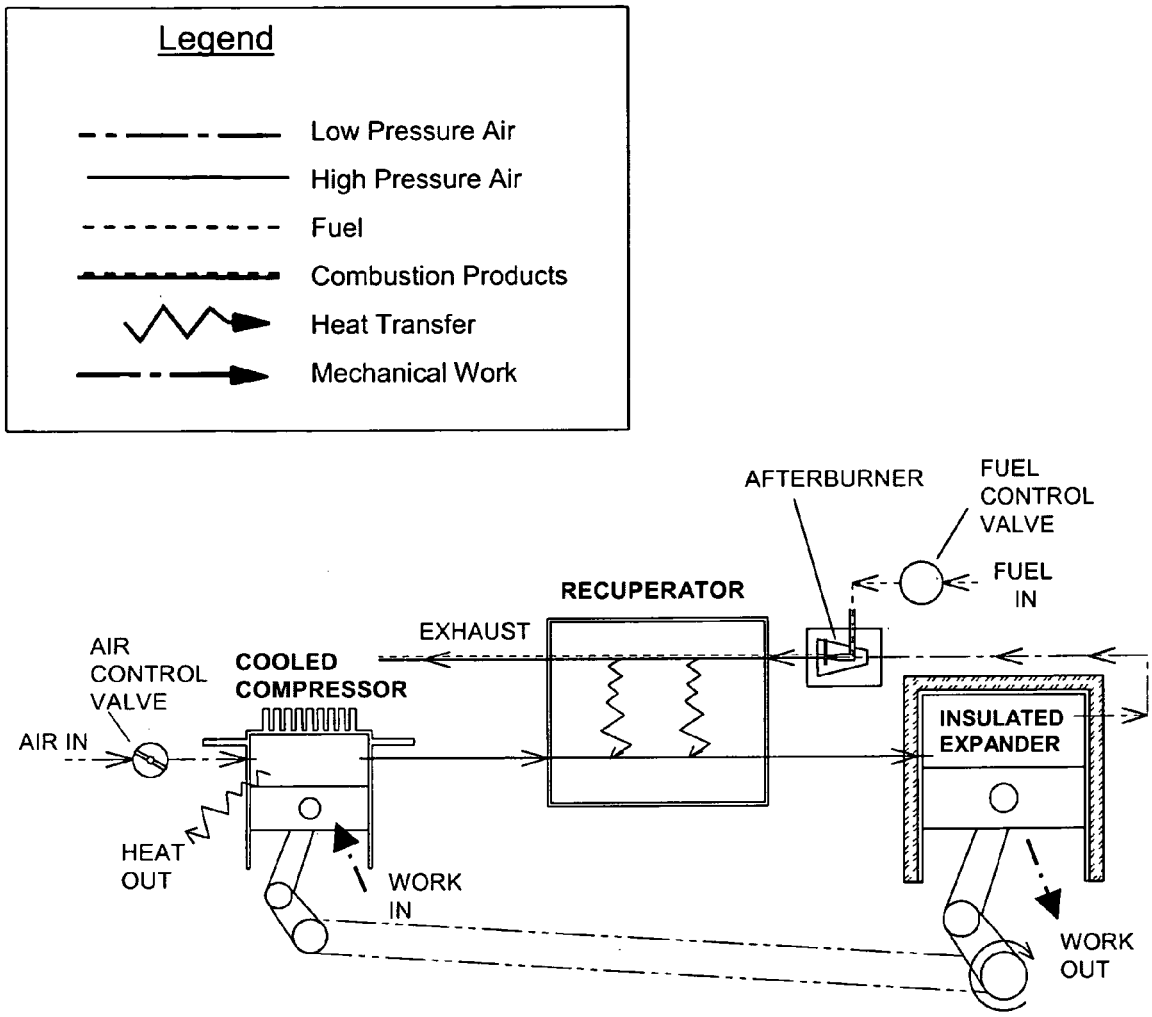
FIG. 5 is a block diagram of an Afterburning, Recuperated, Positive Displacement Engine in basic form.

FIG. 5 is a functional block diagram of the Afterburning, Recuperated, Positive Displacement Engine. Ambient air is compressed by a compressor and then heated in the counterflow heat exchanger (recuperator) to gain heat energy before expanding in an expander to produce work. Fuel is added to the fully expanded air to form a combustible fuel-air mixture that is burned in an afterburner to generate hot exhaust gases that become the hot gas side of the recuperator. The hot exhaust gases are cooled by counterflow heat transfer to the incoming compressed air and are exhausted to the atmosphere at a temperature slightly above the compressor exit temperature. The expansion of the hot air in the expander produces more work than is required to compress the cooled air in the compressor; resulting in a net work output, in the form of shaft power.

The compressor is cooled by air or water to reduce the compression work and to keep the compressor exit temperature low. Since the exhaust temperature approaches the compressor exit temperature as it leaves the recuperator, a low compressor exit temperature reduces the exhaust temperature and keeps the exhaust heat loss at a low level.

The expander is insulated to allow it to utilize nearly all of the energy gained in the recuperator to produce the expansion work. The insulation also isolates the hot air working fluid so that surrounding engine parts and lubricants can be at comparatively low operating temperatures.

A throttle air control valve modulates the flow of air through the engine to control the power output of the engine. A fuel control valve matches the flow of fuel to the airflow with the objective of maintaining the hot gas exiting the afterburner at a nearly constant temperature. Controlling to a constant afterburner temperature avoids speed response lags from waiting for recuperator temperature transients.

Single Cylinder Reciprocating Embodiment

Figure 6:
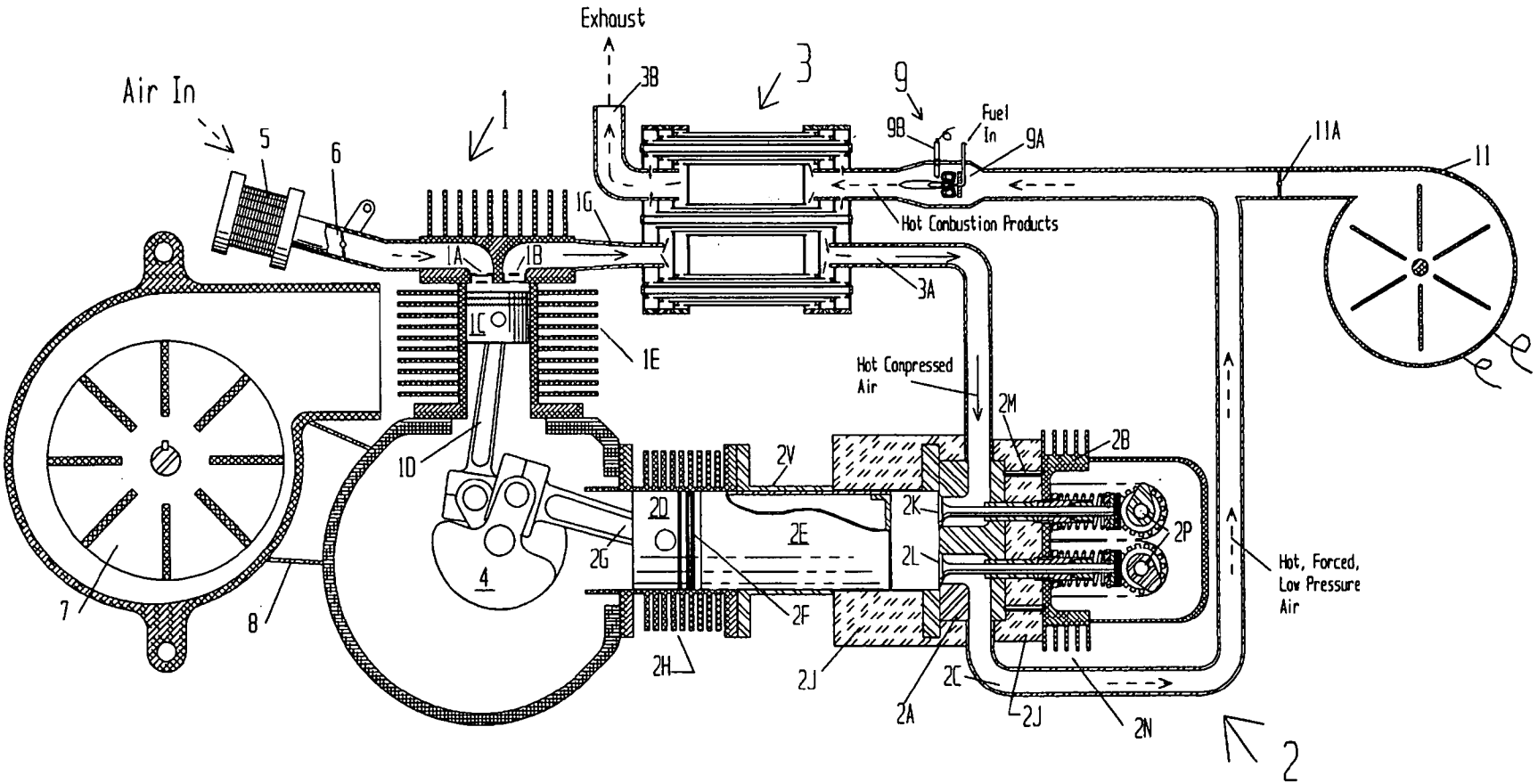
FIG. 6 is a cross section of a liquid or gas fueled, single-expander, Afterburning, Recuperated, Positive Displacement Engine with air cooling.

Referring to FIG. 6 the Afterburning, Recuperated, Positive Displacement Engine will be illustrated as embodied in a gas or liquid fueled, open cycle, reciprocating air engine with a single cylinder compressor 1, a single cylinder expander 2, a recuperator 3, and an afterburner assembly 9. The energy input to the engine is via the fuel supplied to afterburner assembly 9.

Ambient air enters the engine through an air filter 5 and passes through the throttle 6 that can be used to control the amount of air entering the engine. For the gas or liquid fueled embodiment, using the throttle and matching the fuel flow through the fuel nozzle 9A to maintain a constant temperature at the recuperator 3 inlet accomplishes the speed and power control. The preferred method of fuel control is an electronic feedback circuit controlled by a temperature sensor.

After passing by the throttle 6 the air then enters the compressor assembly I through the inlet check valve 1A. The air is then compressed by the piston 1C and exits through the exhaust check valve 1B. Cooling fins on the compressor 1E remove most of the compression heating to reduce the amount of mechanical work required from the crank 4 through the connecting rod 1D. In this air-cooled embodiment, a compressor cooling blower 7 driven by a blower drive belt 8 provides cooling air.

The compressed air is transferred to the recuperator 3 after leaving the compressor assembly 1 through the outlet tube 1G and is heated by counterflow heat transfer from the hot combustion products of the afterburner assembly 9. After being heated in the recuperator, the hot compressed air proceeds through the high pressure outlet tube 3A to the expander assembly 2.

The recuperator 3 can be any suitable high effectiveness, low pressure drop, counterflow heat exchanger that is suitable for the pressures and temperatures. The Proe 90™ gas turbine recuperator (U.S. Pat. No. 6,390,185) is ideally suited for this application.

The hot compressed air passes through the expander inlet valve 2K and expands to force the piston assembly 2D, with its insulating extender 2E, downward. (The piston insulating extender 2E thermally isolates the piston 2D and piston rings 2F from the hot air in the expander.) The downward motion is transmitted to the crank 4 through the connecting rod 2G. The inlet valve 2K closes after piston 2D is only part way down its stroke so that the initial air volume can fully expand and produce work. The pressure ratio of the Afterburning, Reciprocating, Positive Displacement Engine is set by the timing of this intake valve cutoff combined with the relative displacements of the compressor assembly 1 and expander assembly 2.

After the expander piston 2D reaches bottom dead center, the expander exhaust valve 2L opens and remains open until the piston 2D moves to top dead center. The low pressure exhaust exits the expander through exhaust tube 2C and flows to the afterburner assembly 9. Although the air cools in the expander as it produces work by driving the piston, at the preferred pressure ratio of 4 to 6, the air is still at a high temperature when it enters the afterburner assembly 9. Fuel is injected through a fuel nozzle 9A, located within the afterburner assembly 9 to produce the hot exhaust gases. Once the engine is running and warmed up, no ignition means is required since the combustion process is self sustaining. A spark igniter 9B, provides the ignition source to the fuel/air mixture for initial startup.

The expander incorporates several novel heat management devices to both retain heat in the air working fluid and to protect the piston rings 2F and valve drive gear 2P from exposure to high temperatures.

The expander cylinder head is comprised of a "hot" cylinder head 2A that is in intimate contact with the hot air working fluid and a "cold" cylinder head 2B. The objective of the expander head thermal provisions is to minimize the amount of heat lost from the hot cylinder head 2A to the cold cylinder head 2B by limiting the conduction paths between those two parts. The cold cylinder head 2B is mechanically attached to the hot cylinder head 2A by thermal standoffs 2M. The thermal standoffs 2M are long, have the minimum cross section consistent with mechanical strength and are made of relatively low thermal conductivity material such as stainless steel. The valves 2K and 2L are also long, slender, and made from low thermal conductivity ceramic or metal. High performance, high temperature, insulation 2J made from a material such as Refrasil further insulates the cold head 2B from the hot head 2A.

Figure 7:
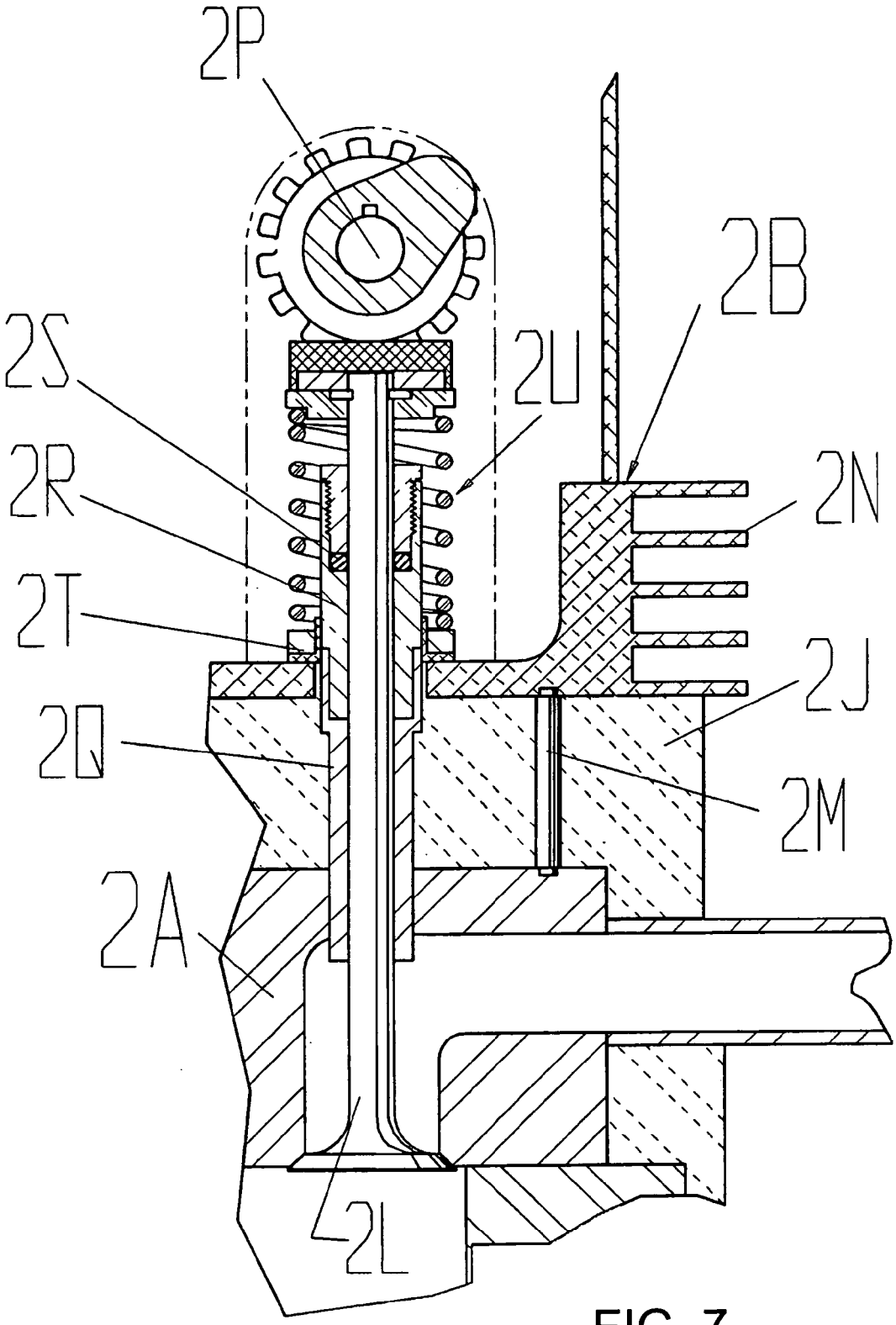
FIG. 7 is a detailed section view of the expander head, showing the thermal control provisions, for a liquid or gas fueled, single-expander, Afterburning, Recuperated, Positive Displacement Engine with air cooling.

Referring also to FIG. 7, additional details of the expander head thermal provisions are explained. (FIG. 7 shows details for an exhaust valve 2L but is equally applicable to the intake valves 2K.) Heat transfer through the valve guides is minimized by a unique valve guide construction. Valve guide thermal standoffs 2Q are attached to the hot head 2A by press fit and/or welding to provide a leak tight joint. Like the thermal standoffs 2M and the valves 2K and 2L, the valve guide thermal standoffs 2Q are long, have minimal cross-section, and are made from low thermal conductivity material. To accommodate thermal expansion, the valve guide thermal standoffs 2Q are not firmly attached to the cold head 2B. A free floating, but tight fitting, thermal bridge 2T conducts the very small heat transferred though the valve guide thermal standoffs 2Q to the cold head 2B. The thermal bridge 2T is firmly pressed against the cold head 2B by pressure from the valve springs 2U. Because heat conducted though the valve guide thermal standoffs 2Q is thereby shorted to the cold head 2B, the valve guide 2R and valve seal 2S are maintained at relatively low temperatures and can be made from conventional, automotive type, materials.

Cooling fins 2N reject what little heat is conducted from the hot head 2A to the cold head 2B. The resulting low temperatures keep the valve drive gear 2P as well as the valve guides 2R, valve seals 2S and valve springs 2U within the temperature limits of their materials and lubricants.

Referring again to FIG. 6, high performance insulation 2J such as Refrasil is also applied to the outside of the expander cylinder assembly 2 in all the areas where the expander structure is exposed to the hot air. Heat loss through conduction down the piston is minimized by a thin wall extension 2E. The corresponding expander cylinder insulating extender 2V also reduces heat loss through conduction along the cylinder. Cooling fins 2H at the base of the expander cylinder assure that the piston rings 2F remain at temperatures consistent with long life with conventional lubrication by removing the small amount of heat conducted through the piston extension 2E and the cylinder insulating extender 2V.

The gas or liquid fueled embodiment of the engine can be started with in two ways. The first is by cranking the engine with a conventional electric starter motor (not shown). Cranking the engine starts air to flow from the compressor 1 to the expander 2 and then into the afterburner assembly 9. After the engine begins cranking, an electric or electronic igniter 9B is turned on and fuel is admitted through fuel nozzle 9A. After the fuel mixes with the air and ignites, igniter 9B is turned off as steady state combustion of the fuel/air mixture continues. When recuperator 3 has become heated to normal operating temperature, the engine will be able to run by itself and the electric starter motor can be stopped and disengaged, just as though starting an internal combustion engine. The engine then commences normal operation.

The preferred starting method is to use starter blower 11 and start blower valve 11A. Before the engine is cranked for starting, valve 11A is opened to allow air flow from electrically driven start blower 11 into afterburner assembly 9. An electric or electronic igniter 9B is turned on and fuel is admitted through fuel nozzle 9A. After ignition, igniter 9B is turned off as steady state combustion of the fuel/air mixture continues. After recuperator 3 has become heated to normal operating temperature, the engine is cranked over by an electric starter motor (not shown). The engine then begins to rotate, valve 11A is closed, blower 11 is turned off, and the engine commences normal operation. Using the starter blower 11 and start blower valve 11A is preferred because it requires less energy for starting than cranking the engine, saves wear on the engine, and provides a steadier air flow for the ignition transient.

Figure 8:
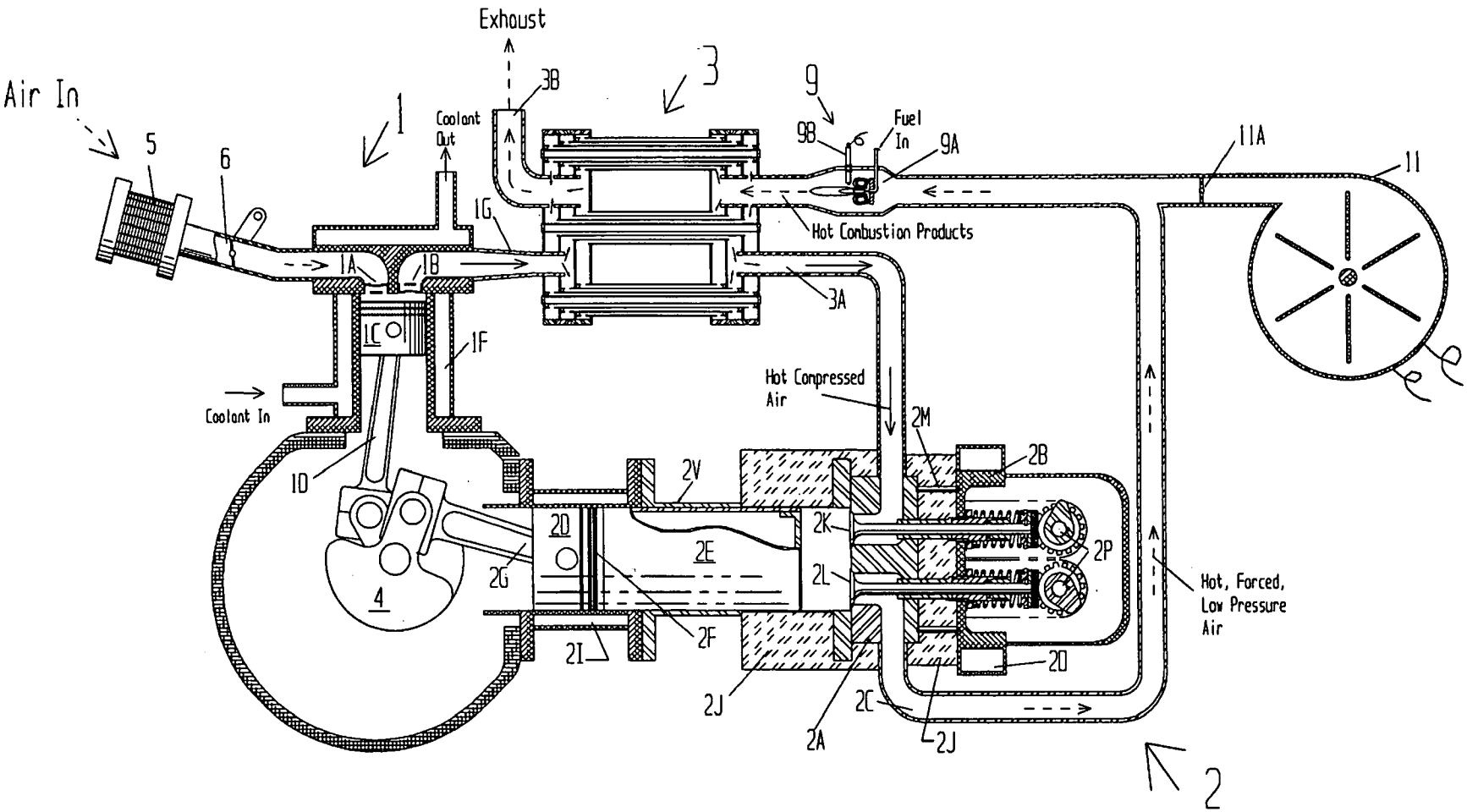
FIG. 8 is a cross section of a liquid or gas fueled, single-expander, Afterburning, Recuperated, Positive Displacement Engine with liquid cooling.

Referring to FIG. 8 an alternative, water-cooled embodiment of the gas or liquid fueled, Afterburning, Recuperated, Positive Displacement Engine is shown. The operation and most parts are the same as an air-cooled embodiment shown in FIG. 6. The compressor cooling fins are replaced by a water jacket 1F and the expander assembly cooling fins are also replaced with a water jacket 21 and 20. Usual automotive coolants can be used for cooling. A usual automotive type waterpump, radiator and cooling fan (not shown) can also be used. Since maximum heat removal from the compressor is the object, no thermostat is necessary. Passing the coolant through the compressor water jacket 1F and then the expander water jacket 21 and 20 is the preferred method since it assures minimum coolant temperature to the compressor.

Figure 9:
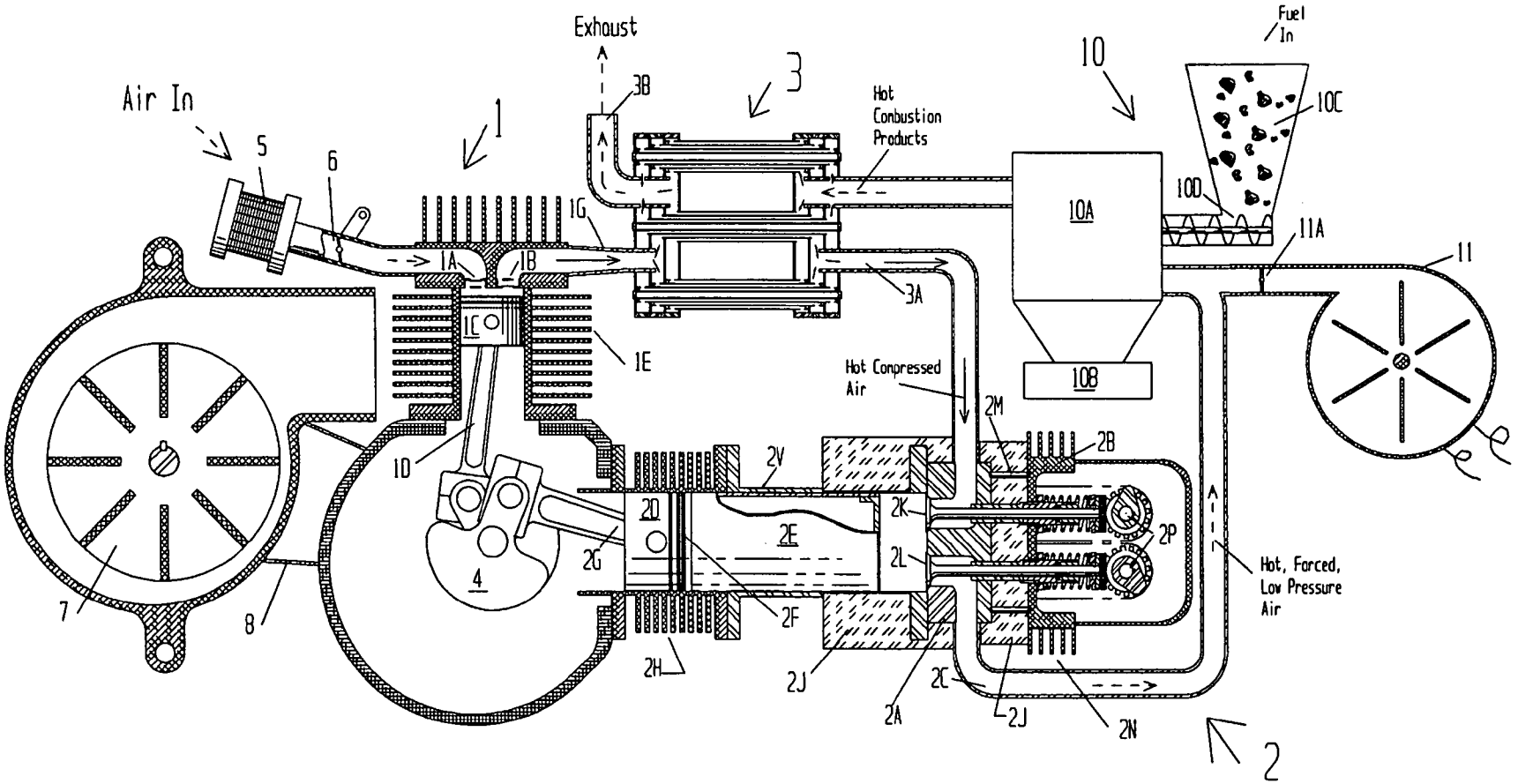
FIG. 9 is a cross section of a solid fueled, single-expander, Afterburning, Recuperated, Positive Displacement Engine with air cooling.
Figure 10:
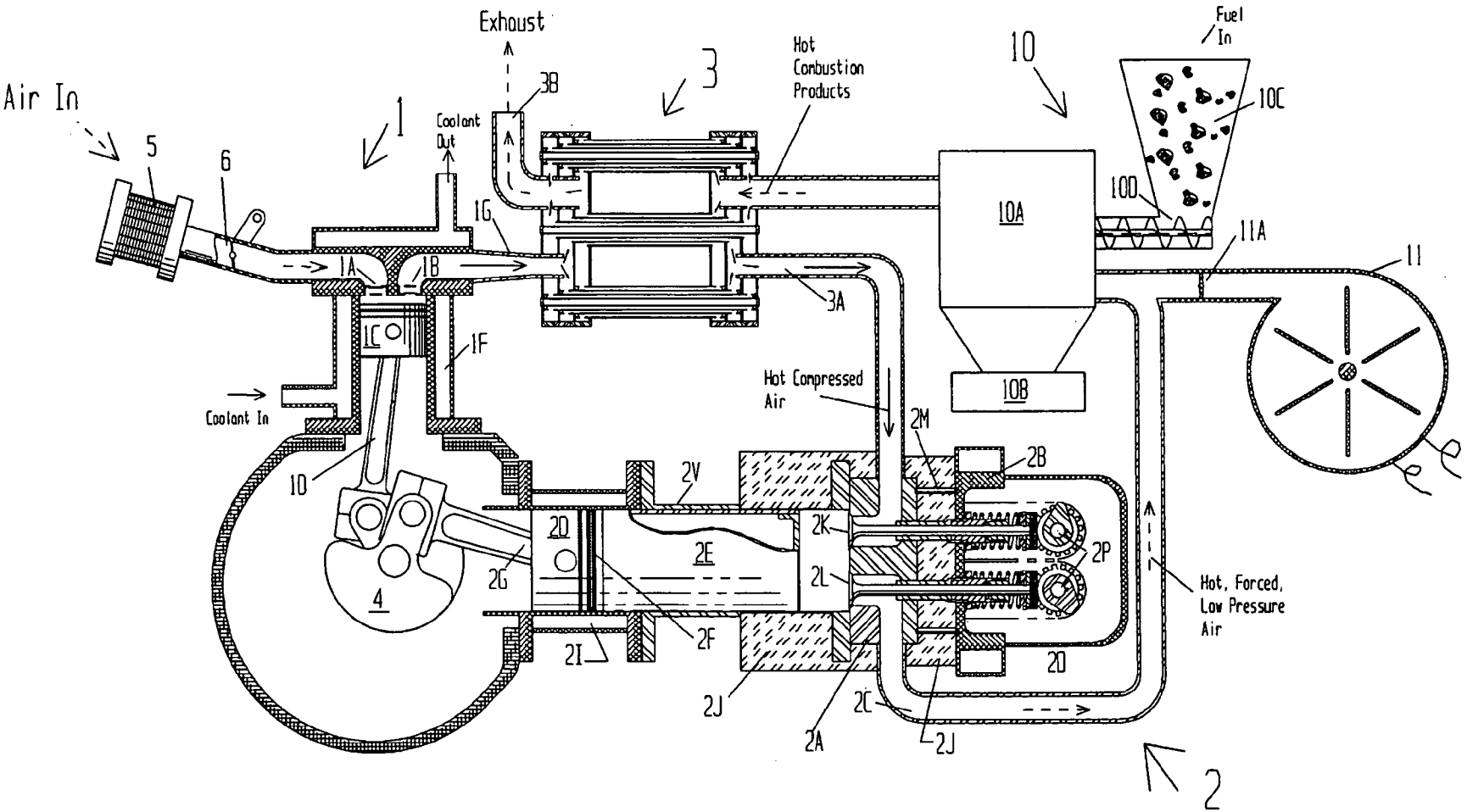
FIG. 10 is a cross section of a solid fueled, single-expander, Afterburning, Recuperated, Positive Displacement Engine with liquid cooling.

Referring to FIG. 9 and FIG. 10, solid fueled embodiments corresponding to the gas or liquid fueled embodiments of FIG. 6 and FIG. 8, respectively, are shown. In the solid fuel embodiment, the afterburner combustor 10 is comprised of an afterburner furnace 10A and ash pit 10B, a fuel hopper 10C, and a stoker device 10D. The afterburner combustor 10 is a solid fuel fired, forced draft, furnace where the forced draft is the hot air exiting the expander through the expander outlet tube 2C. The stoker 10D allows fuel to be added against the forced draft pressure without letting the hot combustion products or air working fluid to leak out. Just as the liquid or gas fueled embodiment of the invention lends itself to leading edge combustion techniques for those fuels, the solid fuel embodiment can cleanly and efficiently burn refuse, wood, pulverized coal and other solid fuels in clean burning furnaces using advanced plug, fluidized bed, or high speed solid combustion technologies such as those disclosed in U.S. Pat. No. 4,553,285 ("Plug Furnace", Sachs et al. 1985), U.S. Pat. No. 6,349,658 ("Auger Combustor with Fluidized Bed", Tyler, 2002) and U.S. Pat. No. 4,632,042 ("Incinerator for the High Speed Combustion of Waste Products", Chang, 1986).

Speed control of the solid fuel embodiment is accomplished by using the throttle 6 for rapid response while controlling the fuel feed speed through the stoker 10D with the object of maintaining a nearly constant recuperator 3 inlet temperature. The exact control means is dependent on the characteristics of the device used for the afterburner furnace 10A.

The solid fueled embodiment of the engine can be started in a manner similar to starting the gas or liquid fueled embodiment. Again, there are two methods for starting. The first is to begin cranking the engine with a conventional electric starter motor (not shown). Cranking the engine starts air to flow from the compressor 1 to the expander 2 and then into the afterburner assembly 10. Afterburner furnace 10A is lit just as though it was a conventional, forced draft, furnace using the expander 2 exhaust from the expander outlet tube 2C as the draft. After recuperator 3 has become heated to normal operating temperature, the engine will be able to run by itself and the electric starter motor can be stopped and disengaged, just as though starting an internal combustion engine. The engine then commences normal operation.

The preferred starting method for the solid fueled embodiment is to use starter blower 11 and start blower valve 11A. Before the engine is cranked for starting, valve 11A is opened to allow air flow from electrically driven start blower 11 into afterburner assembly 10. Afterburner furnace 10A is lit just as though it was a conventional, forced draft, furnace using the draft provided start blower 11. After the furnace is lit and recuperator 3 has become heated to normal operating temperature, the engine is cranked over by an electric starter motor (not shown). The engine then begins to rotate, valve 11A is closed, blower 11 is turned off, and the engine commences normal operation with the furnace blast provided by the now preheated expander exhaust. Using the starter blower 11 and start blower valve 11A is preferred for the solid fuel embodiment, as it was for the gas or liquid fueled embodiment, because it requires less energy for starting than cranking the engine, saves wear on the engine, and provides a steadier air flow for lighting the afterburner furnace 10A.

Alternative Compressor Embodiments

A simple air or water cooled reciprocating compressor is a very straightforward and effective means for compressing the air in an Afterburning, Recuperated, Positive Displacement Engine, but other compressor embodiments have characteristics worth considering.

More effective cooling and lower compression power loss can be achieved by using staged inter-cooled reciprocating compressors. Increased initial and 5 maintenance costs probably offset the slight performance gain but some market conditions could justify the additional complexity.

Figure 11:
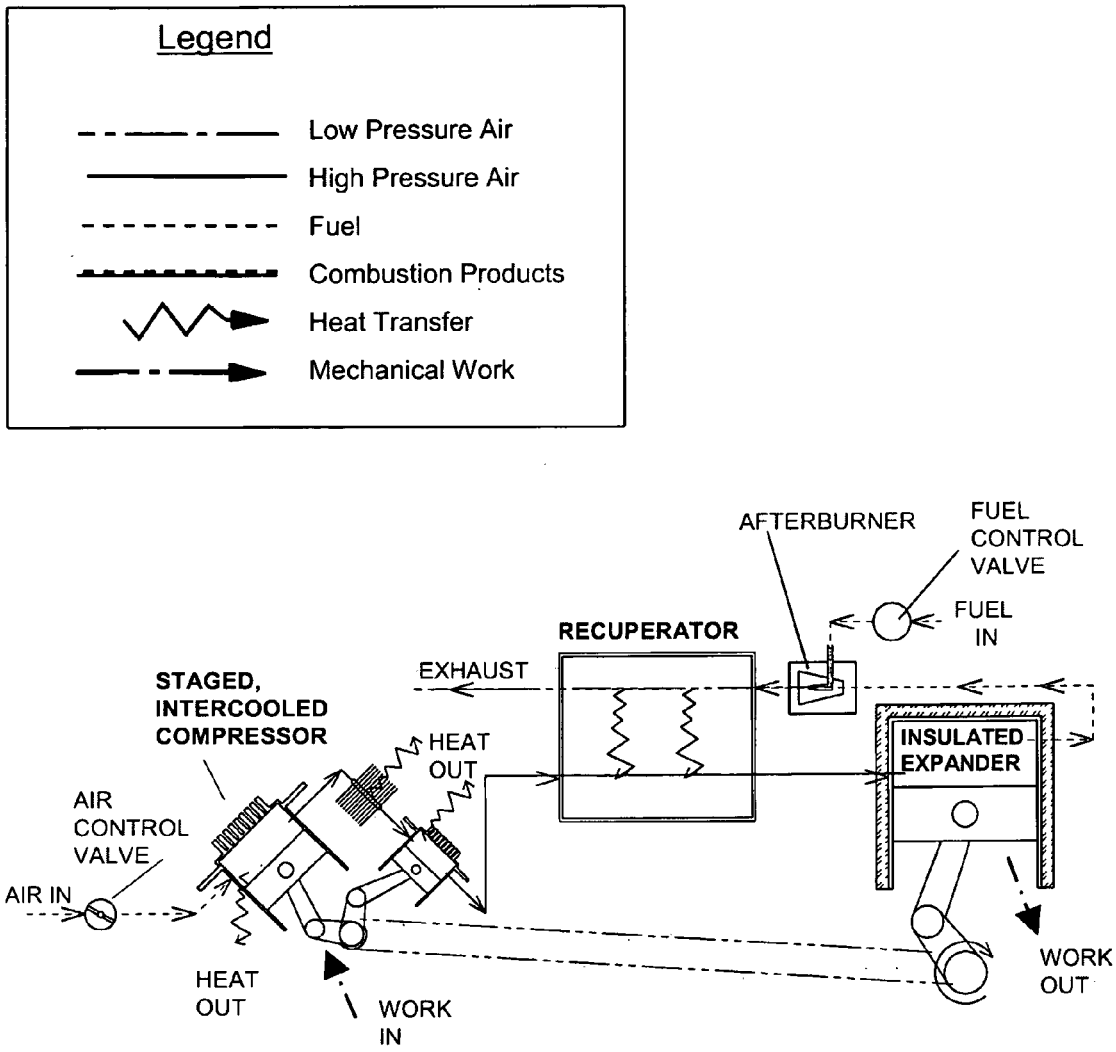
FIG. 11 is a block diagram of an Afterburning, Recuperated, Positive Displacement Engine having a staged-intercooled reciprocating compressor.

Referring to FIG. 11, a block diagram of the Afterburning, Recuperated, Positive Displacement Engine with a staged inter-cooled reciprocating compressor embodiment is shown.

Figure 12:
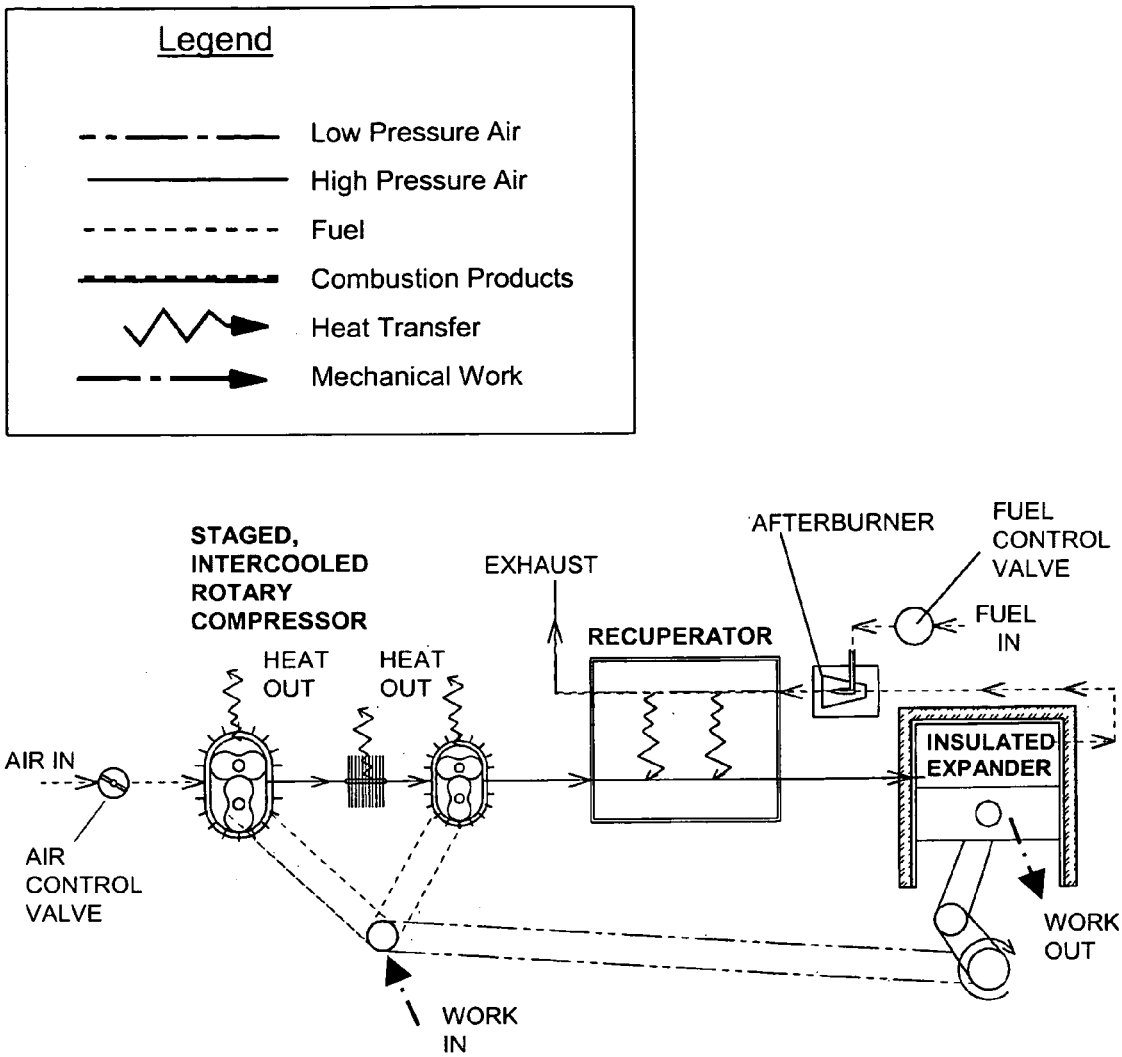
FIG. 12 is a block diagram of an Afterburning, Recuperated, Positive Displacement Engine having a staged-intercooled rotary compressor.

Another compressor alternative is to use a rotating positive displacement compressor such as a Roots blower or scroll compressor. The cooling is not as effective with these compressors and they have flow leakage that reduces efficiency. However, their smaller size could offset those penalties. Referring to FIG. 12, a block diagram of the Afterburning, Recuperated, Positive Displacement Engine with a staged inter-cooled rotary compressor embodiment is depicted.

Dual Cylinder Reciprocating Engine Embodiment

For clarity, a single compressor/expander set is depicted in FIG. 6, FIG. 8, FIG. 9 and FIG. 10. However, operational considerations dictate that the preferred configuration be at least two expander cylinders associated with at least two compressor cylinders with a common recuperator and afterburner. There are two important operational considerations for this invention: 1) assuring that the recuperator pressure remains nearly constant and 2) assuring that the exhaust flow is essentially continuous.

It is important that the recuperator pressure remains nearly constant so the pressure of the air entering the expander is essentially the same as the pressure of the air exiting the compressor. Otherwise, some of the work done to pressurize the air becomes wasted because it is not available to push down the expander piston. In most cases the volumes of the high pressure passages and manifolds in the recuperator are significantly larger than the volume of the expander cylinder when the piston is at the cutoff position. In this case, the recuperator acts as a plenum and its pressure remains essentially constant regardless of the relative crank geometry between the compressor and expander. An engine embodiment with multiple expander and compressor cylinders with equally spaced crank angles also further reduces pressure variation. In any case, if the engine is properly timed, the proper pressure balance can be assured. Proper timing has a compressor exhaust valve just open when the corresponding expander piston is at top dead center. The compressor piston then reaches top dead center when the expander piston reaches its inlet valve cutoff point. With this timing arrangement, each compressor empties at the same time as its corresponding expander fills. The compressor exhaust valve is open at the same time that the expander intake valve is open, giving an unrestricted flow path between the two components. (Slight modifications to this approach to take advantage of air momentum in the valve ports could alter the exact timing, but the objective is the same.)

The objective of continuous combustion requires a nearly steady flow of air into the afterburner assembly. Because a reciprocating expander provides outflow during only half a crank rotation, it is preferred to have at least two expander cylinders so that at least one cylinder is exhausting at all times.

Engine Operation

Referring to FIG. 13 through FIG. 20, the proper operation of the preferred embodiment is shown in a crank angle sequence. These diagrams show compressor and expander piston positions, intake and exhaust valve positions, and flows of air working fluid and hot combustion products every 45 degrees of rotation, or at 8 points in the cycle. One pair of (compressor/expander) cylinders is designated "A" and the other pair "B".

Figure 13:
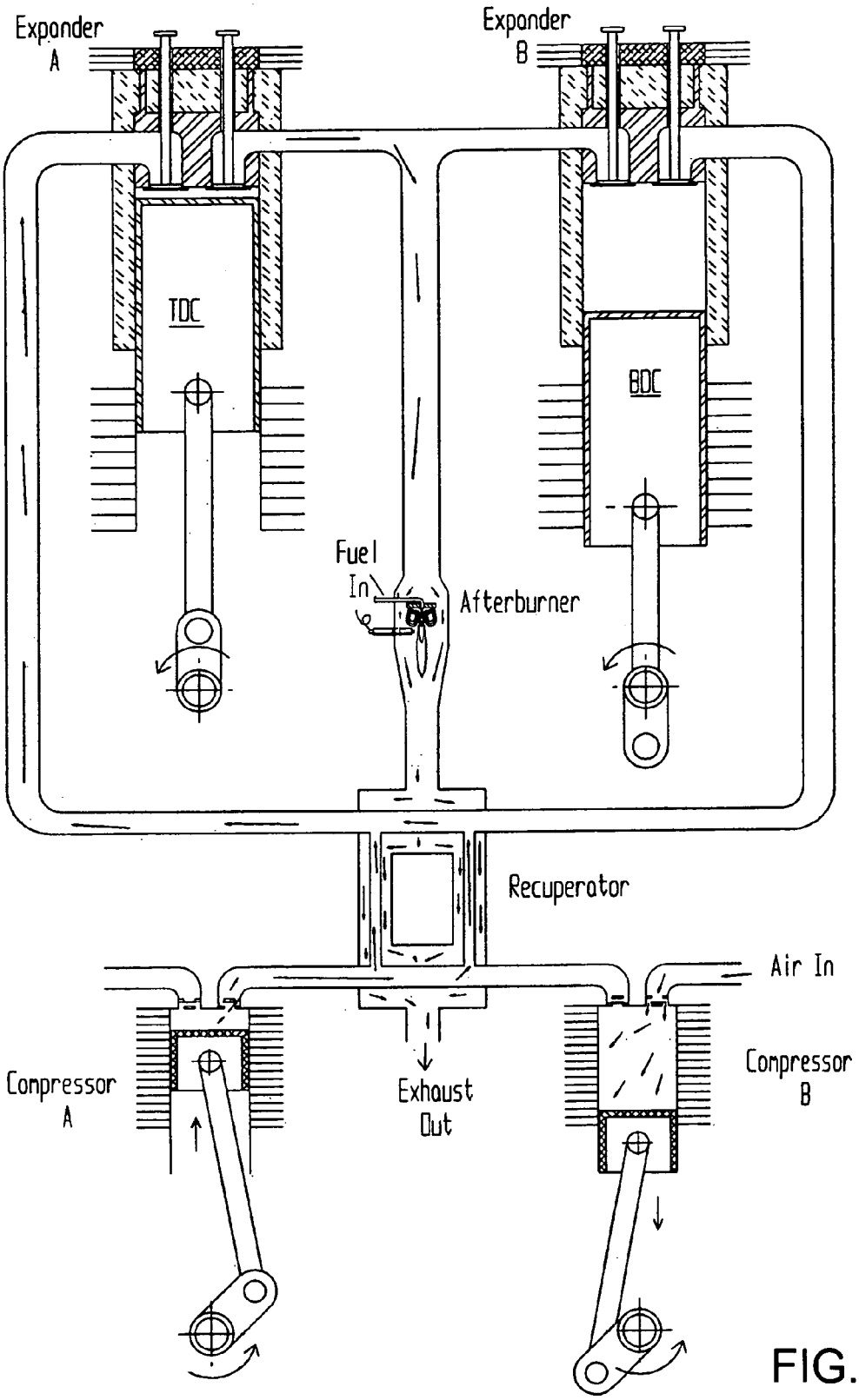
FIGS. 13–20 are schematics of a liquid or gas fueled, dual-expander, Afterburning, Recuperated, Positive Displacement Engine with air cooling with synchronized alternating pistons shown at successive crank angle positions during the complete cycle, i.e.

FIG. 13 shows the start position with the expander A piston at top dead center (TDC) and all expander A valves closed. Compressor A is just starting to expel compressed air through the compressor A exhaust valve. Expander B is at bottom dead center (BDC) with the expander B valves closed and compressor B is filling through the compressor B inlet valve.

Figure 14:
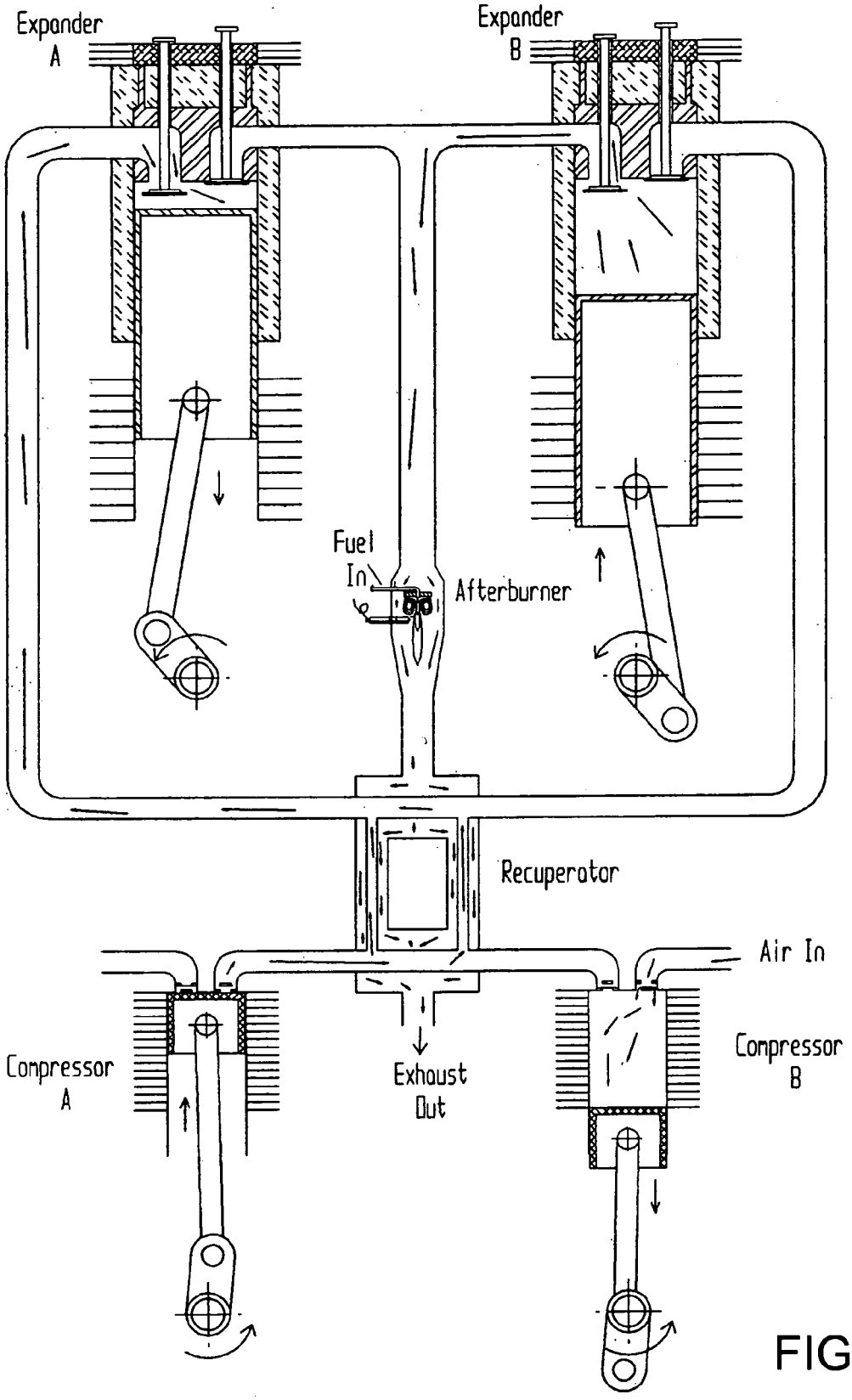

FIG. 14 shows the expander A piston near its intake valve cutoff point and the compressor A piston near top dead center and about to complete expelling compressed air. Between FIG. 13 and FIG. 14 the high pressure air has been flowing from compressor A to expander A through an unrestricted passage with both the compressor A exhaust valve and the expander A inlet valve open. Thus, as intended, with the exception of flow pressure loss, the pressure between compressor A and expander A is constant and is determined by the compressor displacement and the expander cutoff volume. While expander A is on the downstroke, expander B has been on the upstroke and exhausting through the expander B exhaust valve. The air exhausted from expander B provides the combustion air for the common afterburner. The compressor B piston is near BDC and compressor B is completing its filling stroke.

Figure 15:
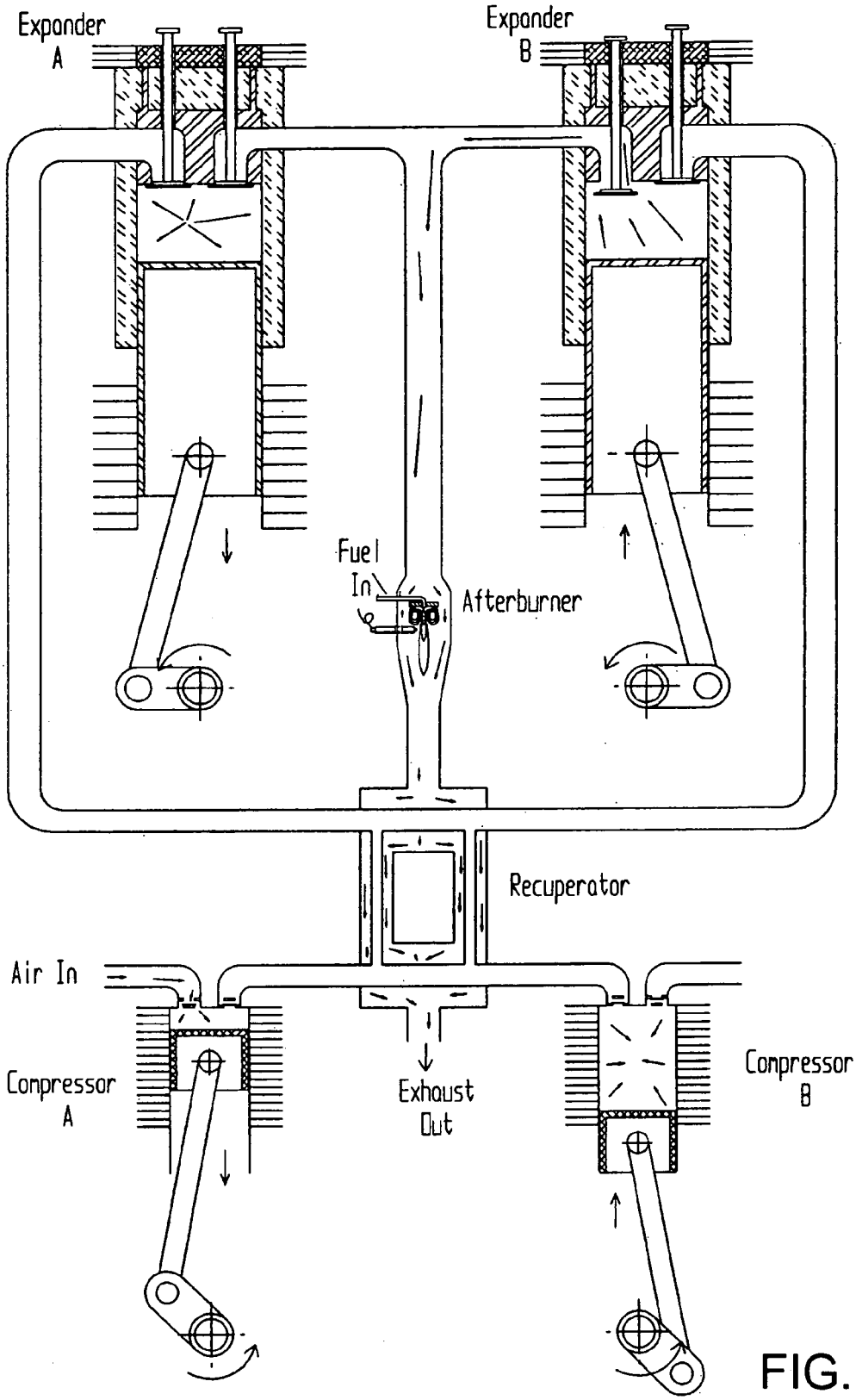

FIG. 15 shows the expander A piston moving downwards with all valves closed while the compressor A piston is moving downwards on the intake stroke with the intake valve open. At this point compressor A is filling and the air in expander A is undergoing the quasi-isentropic expansion from the cutoff pressure. Expander B is continuing its exhaust stroke and providing the combustion air. Compressor B is on the compression stroke. At this point, the pressure in compressor B is less than the recuperator pressure so all the compressor B valves are closed.

Figure 16:
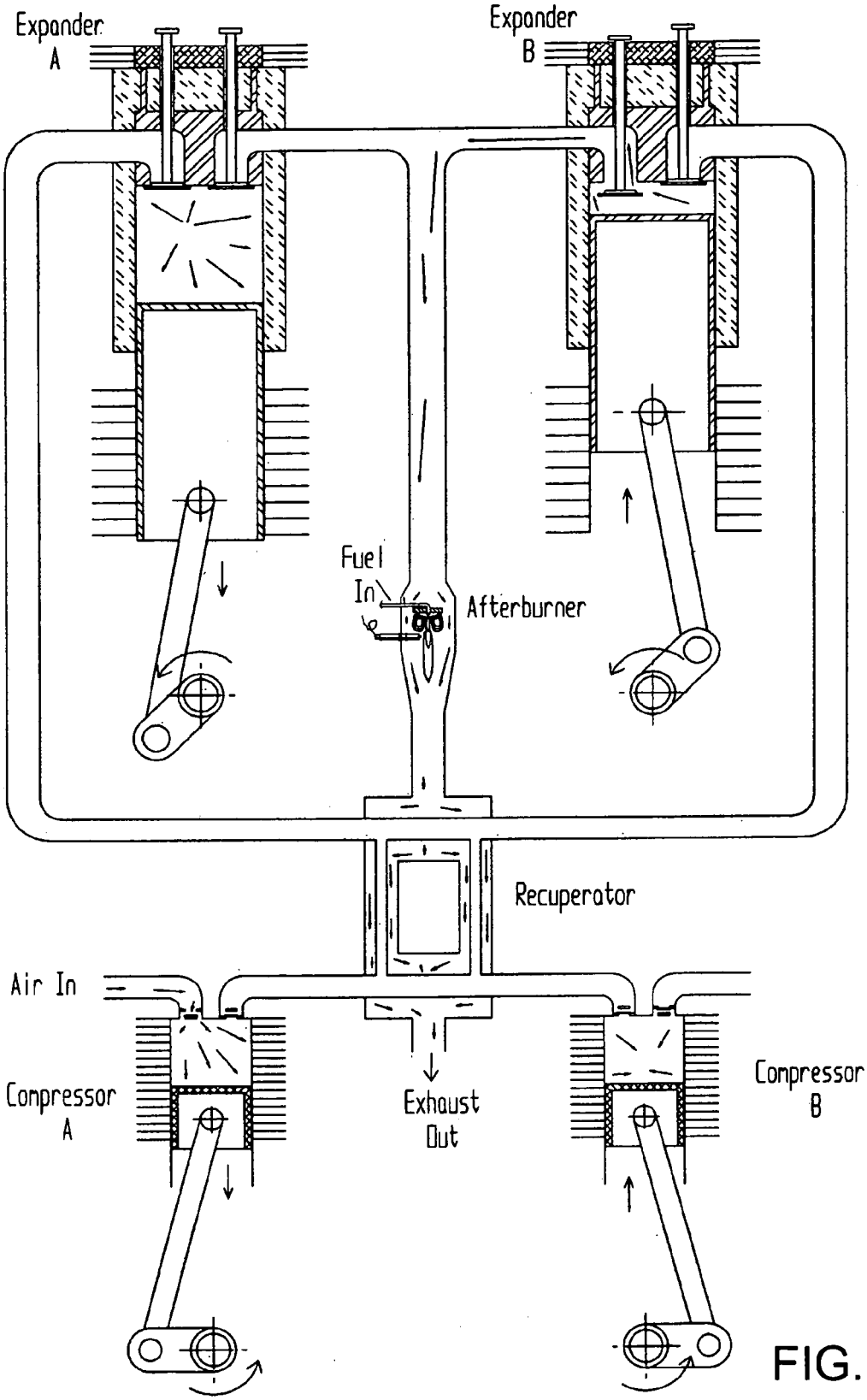

FIG. 16 is the same as FIG. 15 but with an additional 45 degrees of crank rotation.

Figure 17:
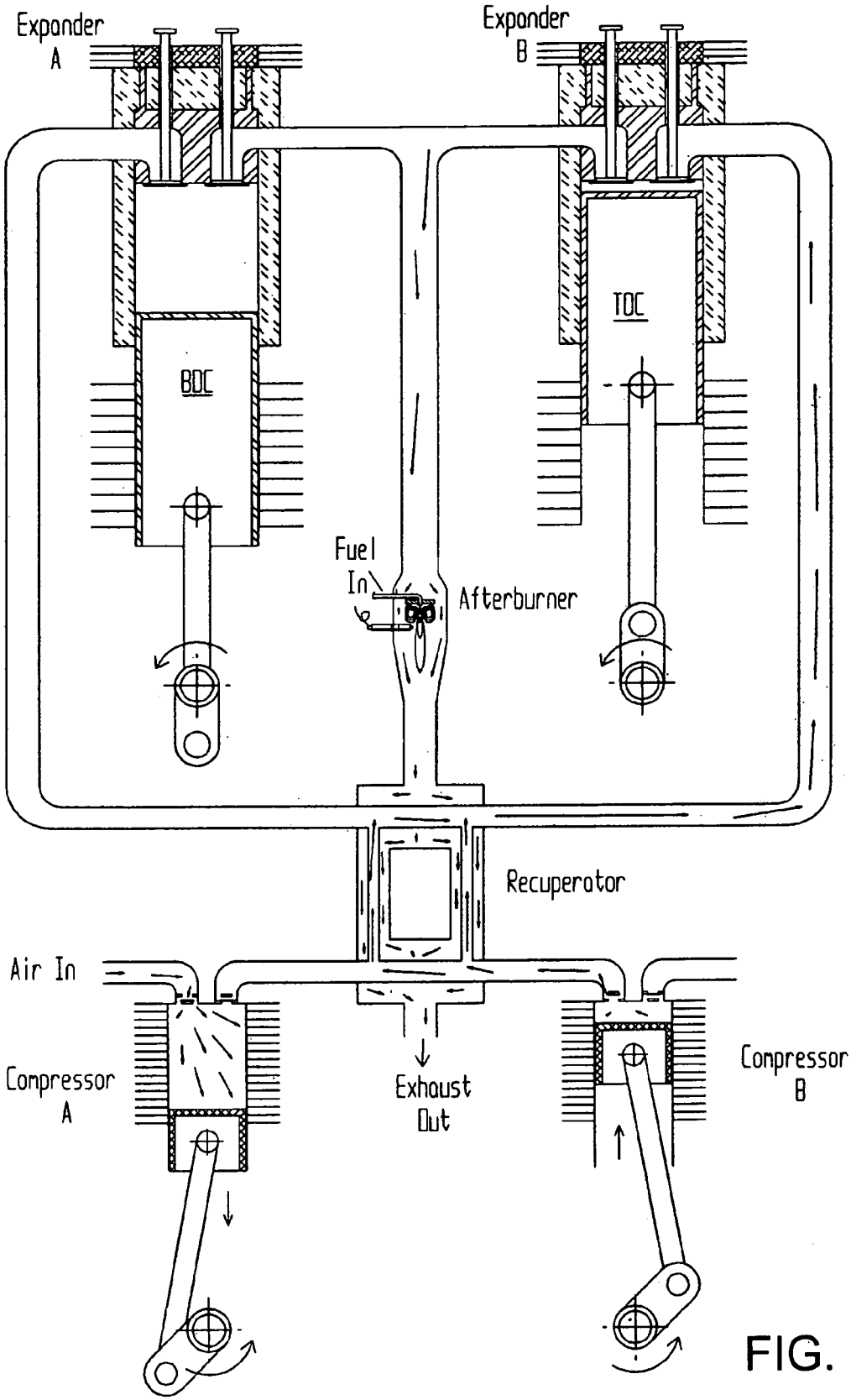

FIG. 17 shows expander A piston at bottom dead center and the compressor A piston still on the intake stroke. The pressure in expander A is now very close to atmospheric and it is about to begin the expander A exhaust stroke. The expander B piston is at top dead center (TDC) and all expander B valves are closed. Compressor B, is just starting to expel compressed air through the compressor B exhaust valve.

Figure 18:
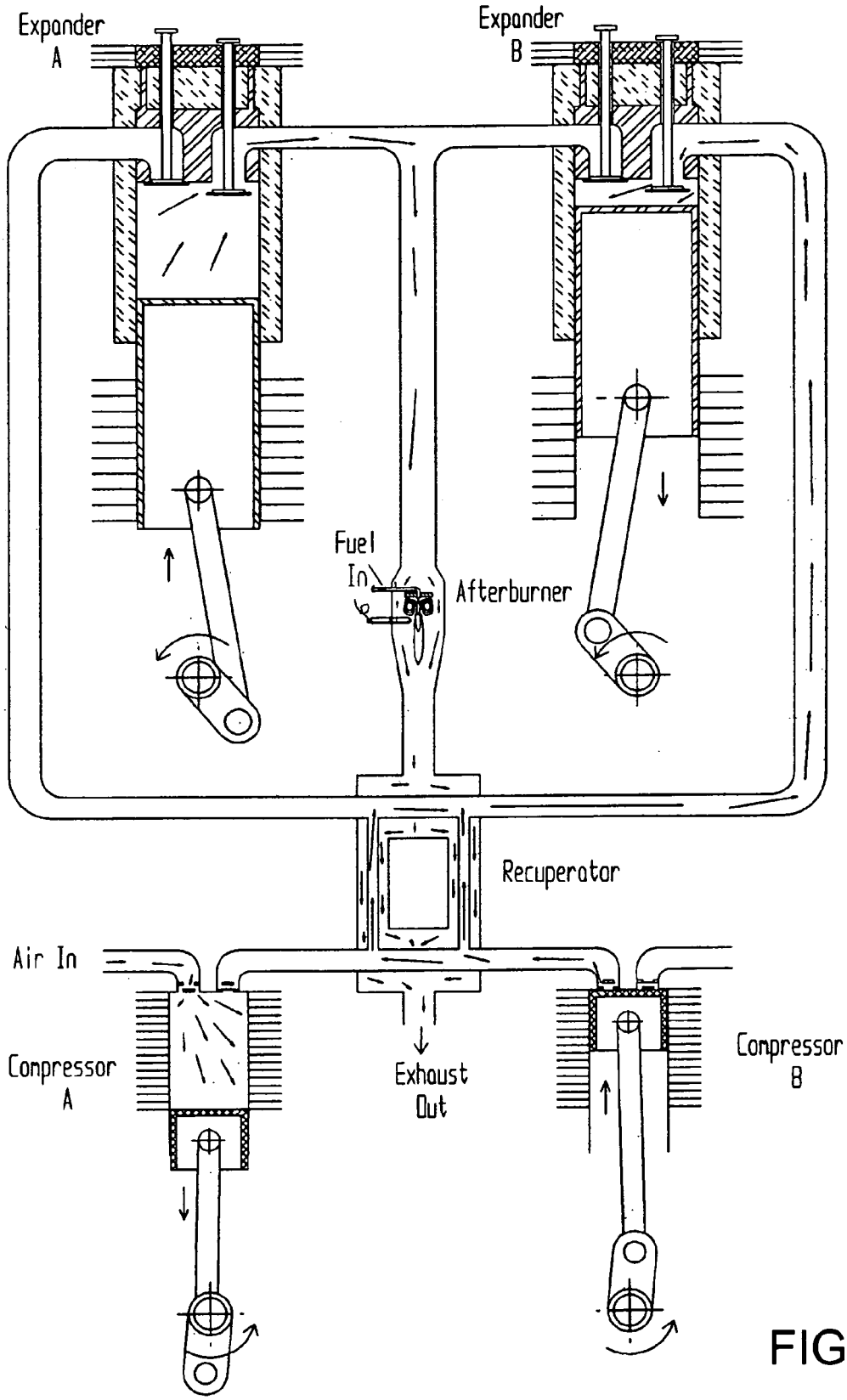

FIG. 18 shows the expander B piston near its intake valve cutoff point and the compressor B piston near top dead center and about to complete expelling compressed air. Between FIG. 17 and FIG. 18 the high pressure air has been flowing from compressor B to expander B through an unrestricted passage with both the compressor B exhaust valve and the expander B inlet valve open. Thus, as intended, with the exception of flow pressure loss, the pressure between compressor B and expander B is constant and is determined by the compressor displacement and the expander cutoff volume. While expander B is on the downstroke, expander A has been on the upstroke and exhausting through the expander A exhaust valve. The air exhausted from expander A now provides the combustion air for the common afterburner. The compressor A piston is near BDC and compressor A is completing its filling stroke.

Figure 19:
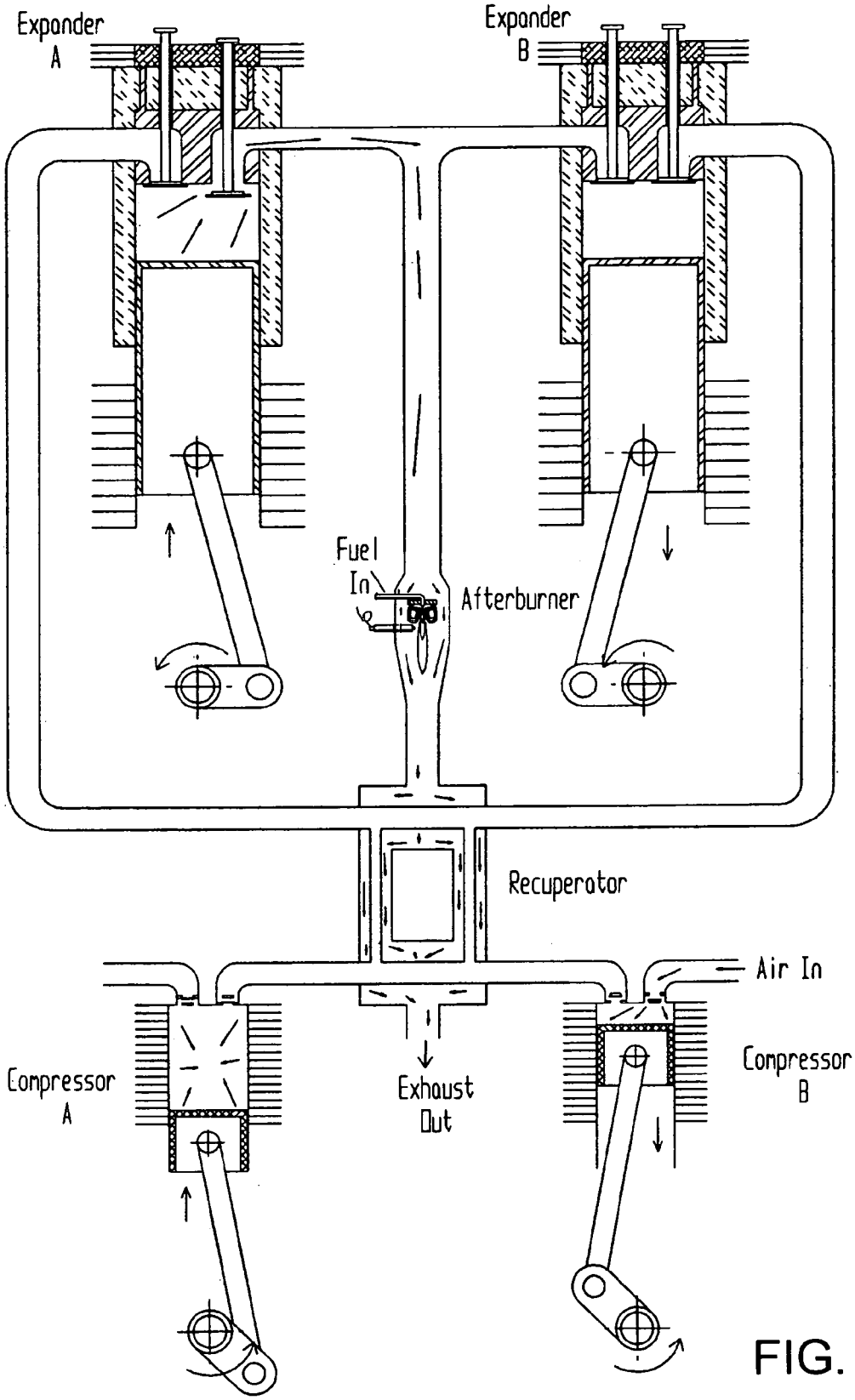

FIG. 19 shows the expander B piston moving downwards with all valves closed while the compressor B piston is moving downwards on the intake stroke with the intake valve open. At this point compressor B is filling and the air in expander B is undergoing the quasi-isentropic expansion from the cutoff pressure. Expander A is continuing its exhaust stroke and providing the combustion air. Compressor A is on the compression stroke. At this point, the pressure in compressor A is less than the recuperator pressure so all the compressor A valves are closed.

Figure 20:
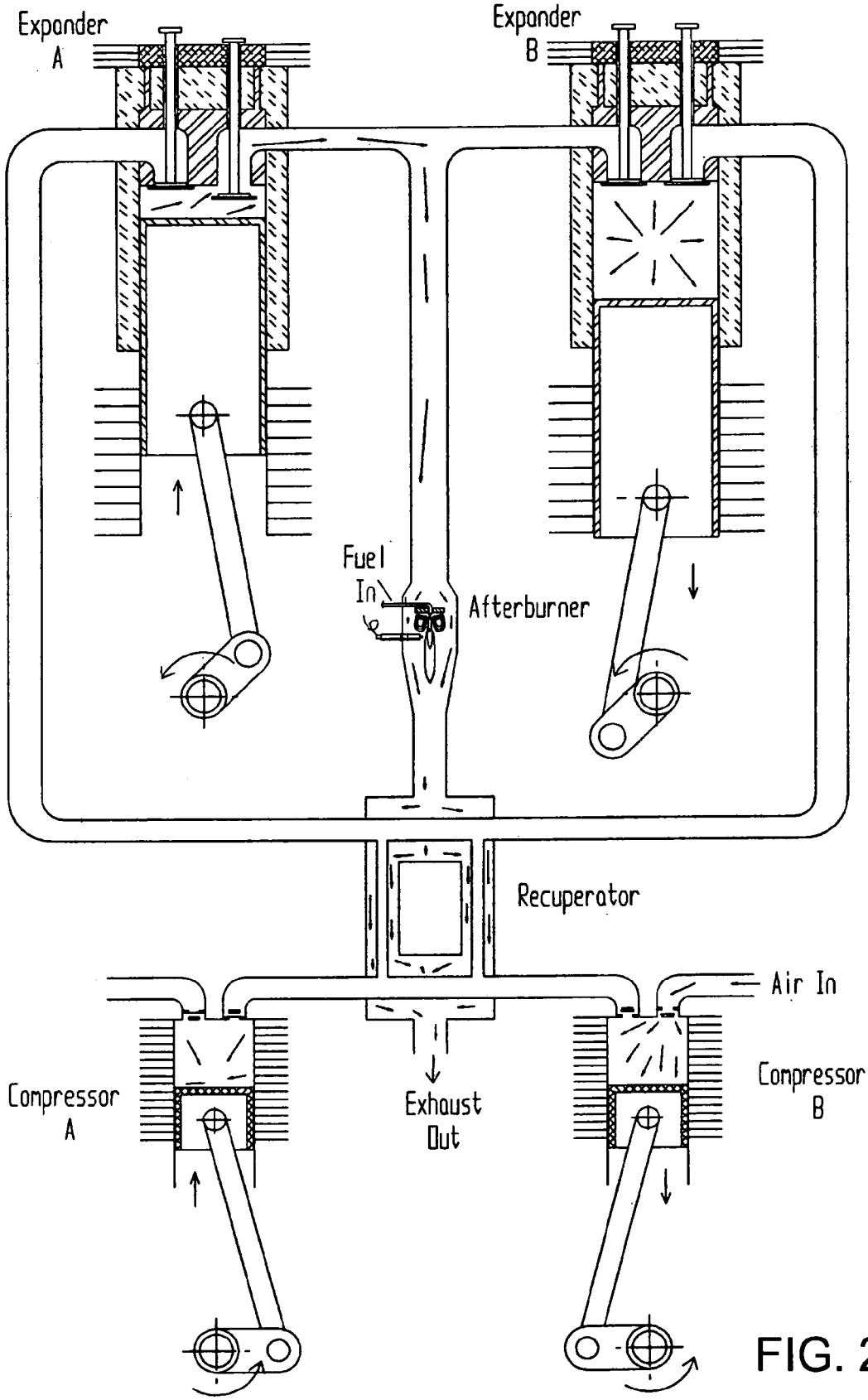

FIG. 20 is the same as FIG. 19 but with an additional 45 degrees of crank rotation. After the crank rotates another 45 degrees past the point depicted in FIG. 20, the engine returns to the condition shown in FIG. 13 and the cycle repeats itself.

Figure 21:
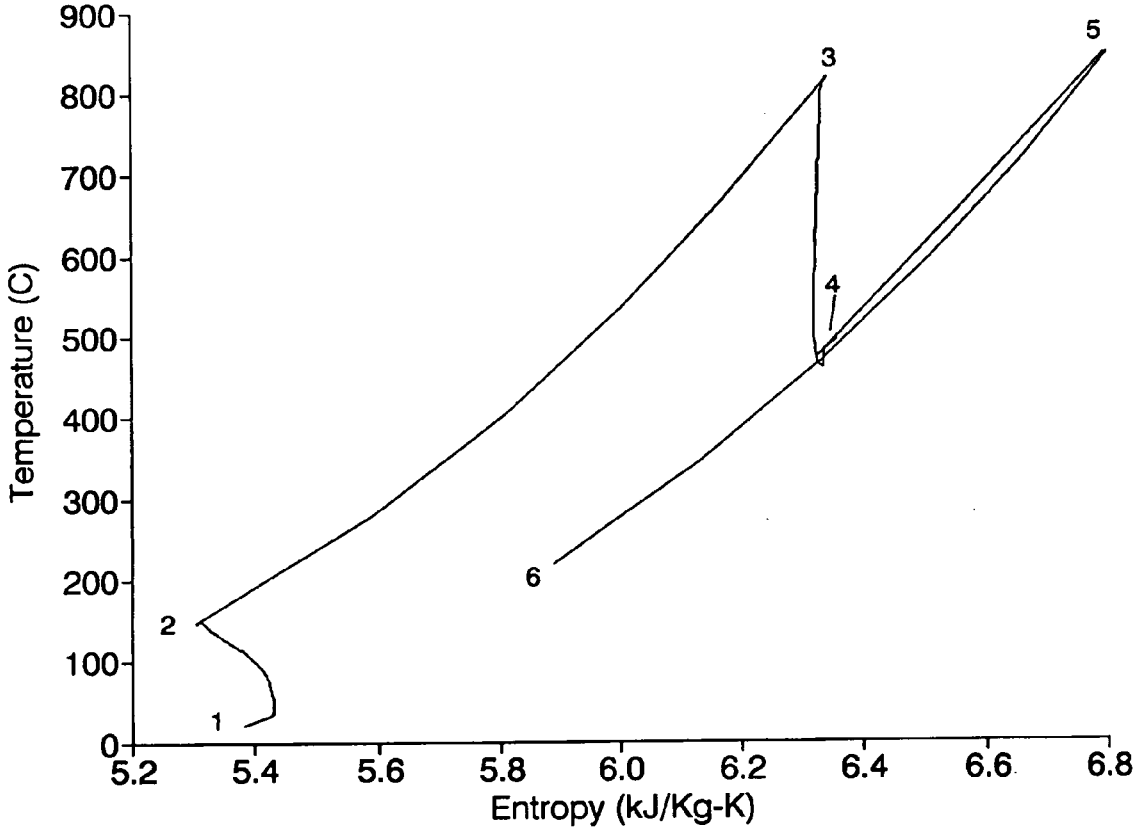
FIG. 21 is a computer predicted temperature-entropy diagram of an actual prototype of an Afterburning, Recuperated, Positive Displacement Engine having two air cooled reciprocating compressor cylinders and two thermally insulated reciprocating expander cylinders.

FIG. 21 shows a predicted temperature-entropy diagram for a prototype of the preferred embodiment: a Dual Cylinder Reciprocating Engine Embodiment of the Afterburning, Recuperated, Positive Displacement Engine. The diagram is for a propane fueled engine, but is representative of other fuels as well. The prototype compressor is a single stage, air-cooled, compressor that has an actual process depicted by point 1 to point 2 in FIG. 21 and is sized for an engine pressure ratio of 4.5. Although the compressor is cooled, the actual compression process differs from an ideal, isothermal process. The compressor cylinder walls are warmer than the incoming, ambient temperature, air and so the air is warmed as it fills the compressor cylinder during the intake stroke. During the first portion of the actual compression, the heat transfer is low, and the process becomes almost isentropic. Finally, the heat transfer becomes more significant and the compression concludes with the entropy decreasing. The compressed air is then heated in the recuperator from point 2 to point 3. Next, the hot, compressed air expands in the expander cylinder from point 3 to point 4. Even after expansion, the air is still hot, 484° C., when it enters the afterburner where it is heated to the recuperator inlet temperature of 816° C. (point 4 to point 5). Finally, the combustion products pass through the recuperator (point 5 to point 6) where they loose their heat to the incoming compressed air. With the prototype, 93% effective, recuperator the recuperator exhaust temperature is 218° C.

Even though the real engine process in FIG. 21 exhibits a number of non-ideal effects, it has a high predicted brake efficiency of 37.2% and a peak combustion temperature of only 840° C. This high efficiency, combined with the ability to achieve similar performance with an extremely wide selection of fuels, demonstrates the great market potential of the Afterburning, Recuperated, Positive Displacement Engine.

Engine Manufacture

The simple mechanical arrangement of the invention facilitates low cost methods of manufacture. With the exception of the high temperature piston insulating extender, cylinder insulating extender, and hot cylinder head (respectively 2E, 2V, and 2A in FIG. 6, FIG. 8, FIG. 9, and FIG. 10) the expander uses the same materials and manufacturing processes as a conventional internal combustion engine. The compressor also is completely conventional in materials and construction. Only the recuperator, high temperature portions of the expander, and interconnecting tubing requires higher temperature materials. Even these parts can be made with conventional machining operations using relatively low cost, but temperature resistant, stainless steels.

Figure 22:
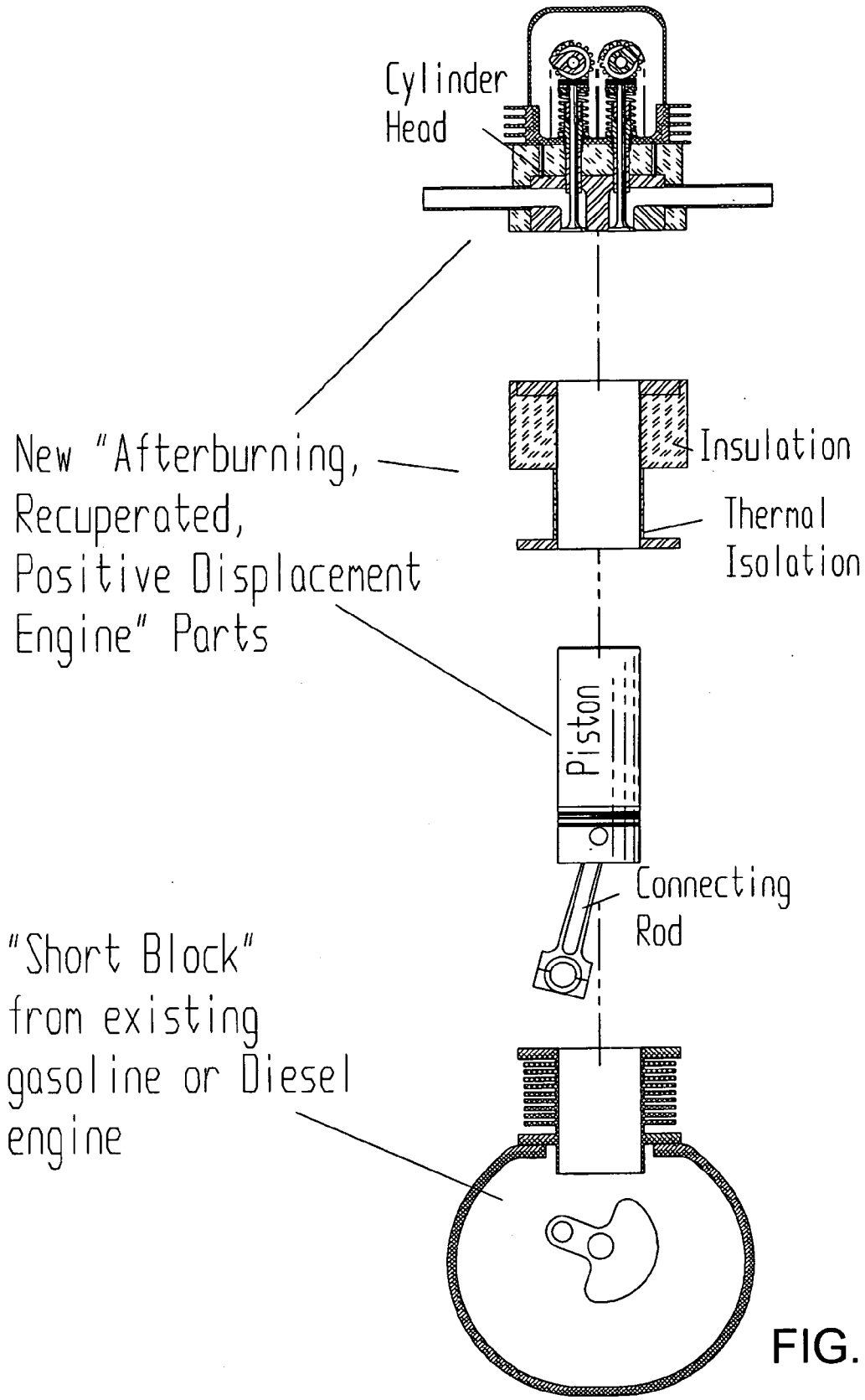
FIG. 22 is a drawing showing how the Afterburning, Recuperated, Positive Displacement Engine expander can be made utilizing existing gasoline or Diesel engine blocks.

Referring to FIG. 22, the expander can make use of an existing "short block" from a reciprocating spark-ignition or Diesel engine that has approximately the needed bore and stroke. Adding the piston with its insulating extender (2D and 2E in FIG. 6, FIG. 8, FIG. 9, and FIG. 10), the corresponding cylinder insulating extender pieces and the insulated cylinder head then completes the expander. The short block provides the crank, bottom end bearings, oil pump, and cooling system. Because the mean effective pressure in the Afterburning, Recuperated, Positive Displacement Engine is so much less than standard spark-ignition or Diesel engines, the loads on the parts are considerably less and engine life is enhanced.

Conclusion, Ramifications and Scope

The Afterburning, Recuperated, Positive Displacement Engine meets the object of providing a practical, low cost, easily manufactured, external low-pressure combustion, open cycle (ELPC/OC) engine that is possible to construct with essentially the same methods, materials, and tools used to build conventional internal combustion engines. Obviously, within the purview of the invention here disclosed, many hardware modifications and variations are possible. These include multi-cylinder crank arrangements; variable expander valve timing mechanisms; rotary piston expanders; rotary screw compressors; a wide range of forced draft afterburning combustor alternatives; and various mechanical, electrical, hydraulic or pneumatic means of linking the compressor and expander. It is also clear that there are numerous methods for constructing the engine using a mix of new and existing engine and compressor parts. It is therefore understood that, within the scope of the appended claims and their legal equivalents, the invention may be practiced otherwise than as specifically described.

I claim:

1. An afterburning, recuperated, positive displacement, external combustion, open cycle heat engine; said engine comprising:

a. positive displacement compressor means for compressing ambient air to a peak pressure while using cooling means to remove heat from said positive displacement compressor means whereby the compression work is minimized;

b. counterflow heat exchange recuperator means for receiving said air at peak pressure from said compressor means and for heating said air using recuperative heating means;

c. positive displacement expander means for receiving said heated air at peak pressure from said recuperator means and for producing work by expanding said heated air to a low pressure while using insulation means to contain heat within said expander means whereby said expansion work is maximized and whereby the mechanical bearings, seals, and lubricants of said expander means are isolated from the high temperature of said heated air and whereby said mechanical bearings, seals and lubricants can obtain long life without needing to be constructed of expensive, temperature resistant, materials;

d. afterburner means for receiving said expanded air at low pressure from said positive displacement expander means, introducing a fuel to said air to form a combustible air-fuel combination, and igniting said air-fuel combination to generate hot combustion gases at a flame temperature; said hot combustion gases being used to provide said recuperative heating means through said counterflow heat exchange recuperator means;

e. connection means whereby said compressor means receives said compression work from a portion of said expansion work from said expander means;

f. control means for changing the speed and power of said engine by regulating the flow rate of said air while simultaneously adjusting the flow of said fuel whereby the speed and power of said engine is controlled and whereby said flame temperature is maintained nearly constant.

2. The engine of claim 1 wherein the fuel is a liquid.

3. The engine of claim 1 wherein the fuel is a gas.

4. The engine of claim 1 wherein the fuel is a solid.

5. The engine of claim 1 wherein said positive displacement compressor means is an inter-cooled rotary compressor such as a Roots blower or scroll compressor.

6. The engine of claim 1 wherein said positive displacement compressor means is at least one reciprocating compressor cylinder means comprising at least one compressor intake valve and at least one compressor exhaust valve and a reciprocating compressor piston connected by a compressor connecting rod to a compressor crankshaft and wherein said positive displacement expander means is at least one reciprocating expander cylinder means comprising at least one expander intake valve and at least one expander exhaust valve and a reciprocating expander piston connected by an expander connecting rod to an expander crankshaft, with said connecting means accomplished by compressor and expander crankshafts being mechanically coupled for proper operation of said engine during one revolution of said crankshafts whereby said linked crankshafts transmit shaft work output to a load.

7. The engine of claim 6 having at least two of said expander cylinders so arranged on said crankshaft that at least one of said expander pistons is always on the exhaust stroke whereby the flow of said expanded air to said afterburner means is continuous with resulting steady state combustion.

8. The engine of claim 6 wherein said expander piston and said expander cylinder have thermal isolation extension means whereby the piston ring seals on said expander piston can operate at a low temperature with conventional oil for lubrication and whereby conduction heat loss from said expander air through said expander piston and cylinder is reduced.

9. The engine of claim 6 wherein the cylinder head of said expander is a two piece assembly wherein the first piece contains the seats for said intake and exhaust valves and is exposed to said high temperature air and wherein the second piece is isolated by insulating means, and wherein heat conduction through the stems and guides of said intake and exhaust valves is minimized by thermal isolation means whereby the seals and operating mechanism for said intake and exhaust valves operate at a low temperature with conventional oil for lubrication and whereby conduction heat loss from said expander air through said expander cylinder head is reduced.

10. The engine of claim 1 wherein said compressor cooling means comprises external cooling fins from which the heat of compression is removed by a blower powered by said connecting means.

11. The engine of claim 1 wherein said compressor cooling means comprises external cooling jackets through which is circulated a coolant that removes the heat of compression via a radiator.

12. The engine of claim 6 wherein said reciprocating compressor cylinder means is a staged reciprocating compressor comprised of at least two series cylinders and an inter-cooler whereby removal of heat of compression is improved.

13. The engine of claim 1 wherein said compressor means is a commercially available air compressor.

14. The engine of claim 8 wherein said low temperature for said piston ring seals is maintained by external cooling fins through which the small amount of heat conducted through said piston extension and said expander cylinder is removed by convection and radiation.

15. The engine of claim 9 wherein said low temperature for said seals and said operating mechanism for said intake and exhaust valves is maintained by external cooling fins through which the small amount of heat conducted through said cylinder head thermal isolation means is removed by convection and radiation.

16. The engine of claim 8 wherein said low temperature for said piston ring seals is maintained by external cooling jackets through which is circulated a coolant that removes the small amount of heat conducted through said piston extension and said expander cylinder by coolant convection.

17. The engine of claim 9 wherein said low temperature for said seals and said operating mechanism for said intake and exhaust valves is maintained by external cooling jackets through which is circulated a coolant that removes the small amount of heat conducted through said cylinder head thermal isolation means by coolant convection.

18. The engine of claim 6 wherein a portion of said reciprocating expander means is comprised of an appropriate commercially available engine block comprising said low temperature portion of said reciprocating expander cylinder, said expander cylinder cooling means, and said expander crankshaft whereby the expander means can be completed by the simple addition of said expander piston with said piston extension, the high temperature/insulated portion of said expander cylinder and said two piece expander cylinder head.

19. The engine of claim 1 further comprising an electrically driven start blower and start valve for starting said engine by a starting method comprising the steps of:

a. admitting a continuous air stream from said start blower via said start valve to said afterburner;

b. introducing a fuel to said air to form a combustible air-fuel combination;

c. igniting said air-fuel combination to generate hot combustion gases at a flame temperature;

d. circulating the hot gas stream from said afterburner through said recuperator until said recuperator has warmed to operating temperature;

e. cranking said engine until said engine begins to run on its own;

f. turning off said starter blower and closing said start valve as said engine begins normal operation.

* * * * *